US007766390B2

(12) United States Patent
Hester et al.

(10) Patent No.: US 7,766,390 B2
(45) **Date of Patent: *Aug. 3, 2010**

(54) SECURING ARRANGEMENT OF LOOSE ELEMENTS IN DRAFT ARRANGEMENT ON WORK SURFACE OF HAND PORTABLE OBJECT

(75) Inventors: Pam Hester, Huntersville, NC (US); Deborah H Mance, Huntersville, NC (US); Ian D. Kovacevich, Charlotte, NC (US); Mary LaValley, Huntersville, NC (US); Daniel Lee Bizzell, Davidson, NC (US); Thomas James Philpott, Charlotte, NC (US); Barry Hester, Huntersville, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/927,624

(22) Filed: Oct. 29, 2007

(65) Prior Publication Data

US 2008/0116683 A1 May 22, 2008

Related U.S. Application Data

(63) Continuation of application No. 11/425,139, filed on Jun. 19, 2006.

(60) Provisional application No. 60/595,841, filed on Aug. 9, 2005, provisional application No. 60/596,735, filed on Oct. 17, 2005.

(51) Int. Cl.
*B42F 5/00* (2006.01)
*B42D 3/00* (2006.01)

(52) U.S. Cl. ..... 281/29; 281/22

(58) Field of Classification Search ..... 281/15.1, 281/18, 20, 21.1, 22, 24, 27.3, 29, 31, 35, 281/51; 283/63.1, 64; 40/124.04, 124.09, 40/124.11, 426, 449, 600, 705, 711, 661.01; 402/78

See application file for complete search history.

(56) References Cited

U.S. PATENT DOCUMENTS 1,987,496 A * 1/1935 Springborn ..... 273/157 R
2,254,498 A * 9/1941 Scharf ..... 40/620

(Continued)

FOREIGN PATENT DOCUMENTS

DE 2517549 A 11/1976

OTHER PUBLICATIONS

Google definition of metal filing.*

(Continued)

*Primary Examiner*—Dana Ross
*Assistant Examiner*—Pradeep C Battula
(74) *Attorney, Agent, or Firm*—Chad D. Tillman; James D. Wright; Tillman Wright, PLLC

(57) ABSTRACT

An apparatus for securely holding and protecting a layout of elements includes a portfolio having a first cover and a first overlay. The first overlay and the first cover are releasably cohered together, preferably utilizing magnetic forces. A loose arrangement of elements can be secured to a work surface of the first cover using the first overlay for safe storage and transport. The apparatus is used in rubber stamping design, stained-glass design, and quilting design.

10 Claims, 23 Drawing Sheets

U.S. PATENT DOCUMENTS

| | | | | | |
|---|---|---|---|---|---|
| 2,975,539 | A | * | 3/1961 | Anderson | 40/600 |
| 3,237,941 | A | | 3/1966 | Vincent | |
| 4,484,745 | A | * | 11/1984 | Sleeper | 273/157 R |
| 4,573,821 | A | * | 3/1986 | Gilreath | 402/78 |
| 4,620,725 | A | * | 11/1986 | Maehashi | 281/45 |
| 5,328,188 | A | | 7/1994 | Brotz | |
| 5,642,883 | A | * | 7/1997 | Rioux | 273/157 R |
| 5,662,326 | A | | 9/1997 | Gebran | |
| 5,711,627 | A | | 1/1998 | Chapman | |
| 5,732,978 | A | * | 3/1998 | Tunnell, IV | 283/34 |
| 5,760,668 | A | | 6/1998 | Testa et al. | |
| 2003/0155761 | A1 | * | 8/2003 | Stenger et al. | 281/39 |
| 2004/0165332 | A1 | | 8/2004 | Beson | |
| 2005/0067780 | A1 | | 3/2005 | Sanyal et al. | |
| 2008/0031681 | A1 | | 2/2008 | Petto | |

OTHER PUBLICATIONS

Particle definition from merriam webster; www.merriam-webster.com/dictionary/particle.* http://www.arnoldmagnetics.com/products/flexible/plastiform_about.htm.* http://www.arnoldmagnetics.com/products/flexible/pdf/plastiform_flexcat.pdf.*

Information Disclosure Statement (IDS) Letter Regarding Common Patent Application(s), submitted by Applicant on Jan. 26, 2009.

"International Search Report" and "Written Opinion of the International Search Authority" (Korean Intellectual Property Office) in Edison Nation, LLC International Patent Application Serial No. PCT/US2007/61085, dated Jun. 22, 2007, 6 pages.

Information Disclosure Statement (IDS) Letter Regarding Common Patent Application(s), submitted by Applicant on Jul. 16, 2009.

* cited by examiner

SECURING ARRANGEMENT OF LOOSE ELEMENTS IN DRAFT ARRANGEMENT ON WORK SURFACE OF HAND PORTABLE OBJECT

I. CROSS-REFERENCE TO RELATED APPLICATIONS

The present application is a U.S. continuation patent application of, and claims priority under 35 U.S.C. §120 to, U.S. nonprovisional patent application Ser. No. 11/425,139, filed Jun. 19, 2006, which '139 application published as U.S. patent application publication number 2007/0049477 A1, and which '139 application is a nonprovisional of, and claims priority under 35 U.S.C. §119(e) to, each of: U.S. provisional patent application No. 60/595,841, filed Aug. 9, 2005; and U.S. provisional patent application No. 60/596,735, filed Oct. 17, 2005. The entire disclosure of each of these patent applications and patent application publication is hereby incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

Scrapbooking has become a widespread hobby. National scrapbooking conventions now are being held in major cities and scrapbooking parties are being held at homes throughout the country. Indeed, it is estimated that scrapbooking is a three billion dollar per year industry.

Perhaps one of the attractions to scrapbooking is the exercise in creativity that is required in putting together a scrapbooking page. The typical scrapbooking page includes more than just photographs. Indeed, a number of additional scrapbooking elements almost always are included that enhance the presentation of the photographs. Such elements include, but are not limited to, souvenirs such as postcards, ticket stubs, and programs; clippings from newspapers and magazines; and commercial scrapbooking products. In this regard, commercial scrapbooking products include, for example, ornamental paper or framing for the photographs; stickers and cutouts having indicia pertaining in some way, for example, to the subject matter of the photographs; and other embellishments.

Due to the numerous elements that may be included on a page of a scrapbook, the layout and design of a scrapbooking page require not only creativity but also time. In working on a layout, a scrapbooker typically loosely places the elements on a scrapbooking page and arranges the elements in different configurations and orientations in searching for the final layout. Only once a final layout is decided upon will a scrapbooking usually begin permanently fixing the elements onto the scrapbooking page. The elements typically are permanently affixed using, for example, an adhesive, such as glue, or mechanical fasteners, such as rivets or grommets.

A consequent problem faced by many of today's scrapbookers at conventions and scrapbooking parties is that of insufficient time to complete a layout before the time for scrapbooking ends. This problem also occurs with an individual scrapbooker who does not have a dedicated table or desk for scrapbooking at his or her house. Often, such a scrapbooker is interrupted and must stop scrapbooking for some reason prior to finishing the layout.

In such situations, a scrapbooker typically will quickly sketch his or her intended design as of the moment that scrapbooking is to end. Based on the sketch, the scrapbooker is able to re-create the layout at the next scrapbooking session. Accordingly, the scrapbooker will take the elements of the layout and store them in the appropriate places and containers for the next scrapbooking session, thereby actually disassembling the page layout.

An alternative approach taken by scrapbookers is to simply place the draft scrapbooking page containing the layout having the loose elements thereon into a scrapbooking album and use the pages of the scrapbooking album to hopefully contain the scrapbooking elements on the draft scrapbooking page. This approach can be risky and requires delicate handling of the scrapbooking album, including maintaining the album in a generally horizontal orientation so that elements of the draft scrapbooking page do not fall out of the scrapbooking album and become disassociated from the draft scrapbooking page.

Alternatively, in such a situation a scrapbooker may simply abandon the layout only to start from scratch at the next scrapbooking session, thereby loosing whatever investment of time that has been spent in attempting to layout the elements of the draft scrapbooking page.

None of these alternatives presents an ideal solution for the scrapbooker, and a need exists by which scrapbookers may place their scrapbooking page designs on hold pending their return to scrapbooking, wherever and how ever long that may be.

IV. SUMMARY OF THE INVENTION

The present invention includes many aspects and features.

Moreover, while many aspects and features relate to, and are described in, the context of scrapbooking, the present invention is not limited to use only in scrapbooking, as will become apparent from the following summaries and detailed descriptions of aspects, features, and one or more embodiments of the present invention. Thus, as will be appreciated, the present invention has applications outside of scrapbooking and can be used in similar manner and fashion, for example, in rubber stamping design, stained-glass design, and quilting design. When used for scrapbooking, a draft scrapbooking page and elements of the draft scrapbooking page are retained between an overlay and a respective cover. When used in other fields, loose elements similarly can be maintained in a particular arrangement.

First Aspect of the Invention

In an aspect of the invention, a method of securing an arrangement of loose elements of a scrapbooking page in a particular arrangement on the scrapbooking page. The method includes the steps of positioning the draft scrapbooking page on top of a work surface; positioning the elements of the scrapbooking page on top of the draft scrapbooking page; and, positioning an overlay on top of the elements of the scrapbooking page without altering the particular arrangement of elements. The overlay coheres directly (and indirectly through the draft scrapbooking page and elements thereof) to the work surface and servers to retain the elements of the draft scrapbooking page in the particular arrangement thereon. In accordance with a feature of this aspect, an overlay and a cover are releasably cohered together such that the overlay can be removed from its cohesion with the work surface without substantially altering or disrupting the arrangement of any loose items or elements disposed between the overlay and the page. In accordance with another feature of this aspect, the overlay is opaque. In still yet another feature, the overlay is entirely opaque and includes no clear, translucent portions.

Second Aspect of the Invention

In another aspect of the invention, an apparatus for securing an arrangement of loose elements of a scrapbooking page in a particular arrangement on the scrapbooking page includes a portfolio having first and second covers, each cover having a width and height each of which exceeds the width and height of a scrapbooking page; and a first overlay having a width and height each of which exceeds the width and height of a scrapbooking page. The first overlay and the first cover are releasably cohered together, preferably utilizing magnetic forces. A scrapbooking page and loose elements arranged thereon thereby may be secured between the overlay and the cover for safe storage and transport between scrapbooking sessions. In accordance with a feature of this aspect, an additional, second overlay is provided that is releasably cohered with the second cover of the portfolio. Preferably, the overlays are interchangeable for use with either cover of the portfolio. In accordance with another feature, the portfolio preferably lies flat with its covers in parallel relation to one another on a common horizontal surface so that each cover presents a work space for arrangement of loose elements on a draft scrapbooking page. Two layouts thereby can be designed simultaneously. This is especially convenient when the two scrapbooking pages are to correspond to each other, either in subject matter, design layout, or otherwise. For example, the two scrapbooking pages may be designed to collectively make a coordinated presentation.

Third Aspect of the Invention

In accordance with yet another aspect of the invention, an apparatus includes a portfolio having a carrying case comprising two generally clam shell shaped halves; first and second inner liners disposed within the clam shell shaped halves; first and second slidable work surfaces having a width and height each of which exceeds the width and height of a scrapbooking page, the first and second slidable work surfaces being received by the first and second inner liners to define first and second storage compartments; feet disposed on the exterior surface of the clam shell shaped halves; and first and second overlays having a width and height each of which exceeds the width and height of a scrapbooking page, and having a width and height smaller than the width and height of the slidable work surface. The first overlay and the first work surface are releasably cohered together, preferably utilizing magnetic forces. A scrapbooking page and loose elements arranged thereon thereby may be secured between the overlay and the work surface for safe storage and transport between scrapbooking sessions. Preferably, the overlays are interchangeable for use with either work surface of the portfolio. In a feature of this aspect, the two clam shaped halves are mirror images of each other. In another feature, the feet are rubber feet for supporting the portfolio. In accordance with a feature of this aspect, the first and second clam shell shaped halves are made by thermoforming processes. Preferred materials from which the clam shaped shells are made include, for example, synthetic suede and closed cell foam. In accordance with another feature of this aspect, the carrying case has integral carrying handles and, for example, may be formed during preferred thermoforming processes. In accordance with another feature, the carrying case is trimmed via a punch process after thermoforming to allow for different portfolio profiles, shapes and/or styles, especially along the peripheries of the clam shaped halves. In accordance with another feature, the carrying case includes a closing feature that preferably comprises a magnetic closure. In accordance with another feature of this aspect, the carrying case is substantially rigid and is formed from a molded plastic. The carrying case may include substantially rigid structures formed from molded plastics encased by a more resilient covering that is co-molded or thermoformed on the rigid structures. The first and second inner liners preferably are made of rigid material, such as molded plastic. In accordance with another feature, each of the first and second inner liners has a frame defining integral receiving tracks disposed on three sides of the perimeter of the inner liner, with each frame dimensioned to receive and retain the periphery of a work surface. In accordance with a related feature, the first and second slidable work surfaces are sized to fit the inner liner tracks that define the frames. In accordance with a feature of this aspect, the work surfaces and the overlays are releasably cohered together such that the overlay can be removed from its cohesion with the work surface without substantially altering or disrupting the arrangement of any loose items or elements disposed between the overlay and the scrapbooking page. In another feature of this aspect, each overlay has a lifting tab preferably centered on at least one of the sides of the overlay for easy lift and peeling of the overlay from the work surface and any scrapbooking page and elements covered by the overlay. In another feature of this aspect, the overlay is opaque. In a related feature, the overlay is entirely opaque and includes no clear or translucent portions. In a further feature of this aspect, feet are disposed on both or either side of the two clam shell shaped halves. Preferably, four rubber feet are disposed in each of the four corners of each clam shell shaped half. The rubber feet may be either of the screw-off or pop-off types. The rubber feet further may include customized indicia and/or advertisements relating to scrapbooking, such as logos or trademarks. In yet another aspect of this aspect, the two storage compartments formed between the interior of each of the inner liner and a slidable work surface serve as storage for scrapbooking elements and other items.

Cohesion Between the Overlay and the Work Surface/Cover

In each of the foregoing aspects, the overlay and the work surface or cover are releasably cohered together by magnetic forces. In this respect, the overlay may includes a magnetic material and the work surface/cover may include: a magnetic material; a ferromagnetic material; or a paramagnetic material. In one embodiment, the work surface/cover includes a thin steel sheet disposed within an exterior covering such as, e.g., a vinyl covering. The magnetic material of the overlay and the steel sheet are magnetically attracted to each other whereby the overlay is cohered to the work surface/cover. In alternative embodiments, the work surface/cover may includes a magnetic material and the overlay may include: a magnetic material; a ferromagnetic material; or a paramagnetic material. In an embodiment, the overlay may include a thin steel sheet disposed within an exterior vinyl covering to which the work surface/cover is magnetically attracted. However, in a currently preferred embodiment, the overlay includes a fabric that contains iron filaments and the work surface/cover includes permanent magnets, whereby the overlay and work surface/cover are magnetically attracted to one another.

In addition to the aforementioned aspects and features of the present invention, it should be noted that the present invention further includes the various possible combinations of such aspects and features.

V. BRIEF DESCRIPTION OF THE DRAWINGS

Further aspects, features, embodiments, and advantages of the present invention will become apparent from the following detailed description with reference to the drawings, wherein:

FIG. 1 is a perspective view of a scrapbooker using a portfolio 100 in accordance with a preferred embodiment of the present invention.

FIG. 2 is a top perspective view of the portfolio of FIG. 1 illustrating the overlays 110,112 cohered to the work surfaces 108,106 of the covers 102,104.

Figure 9:
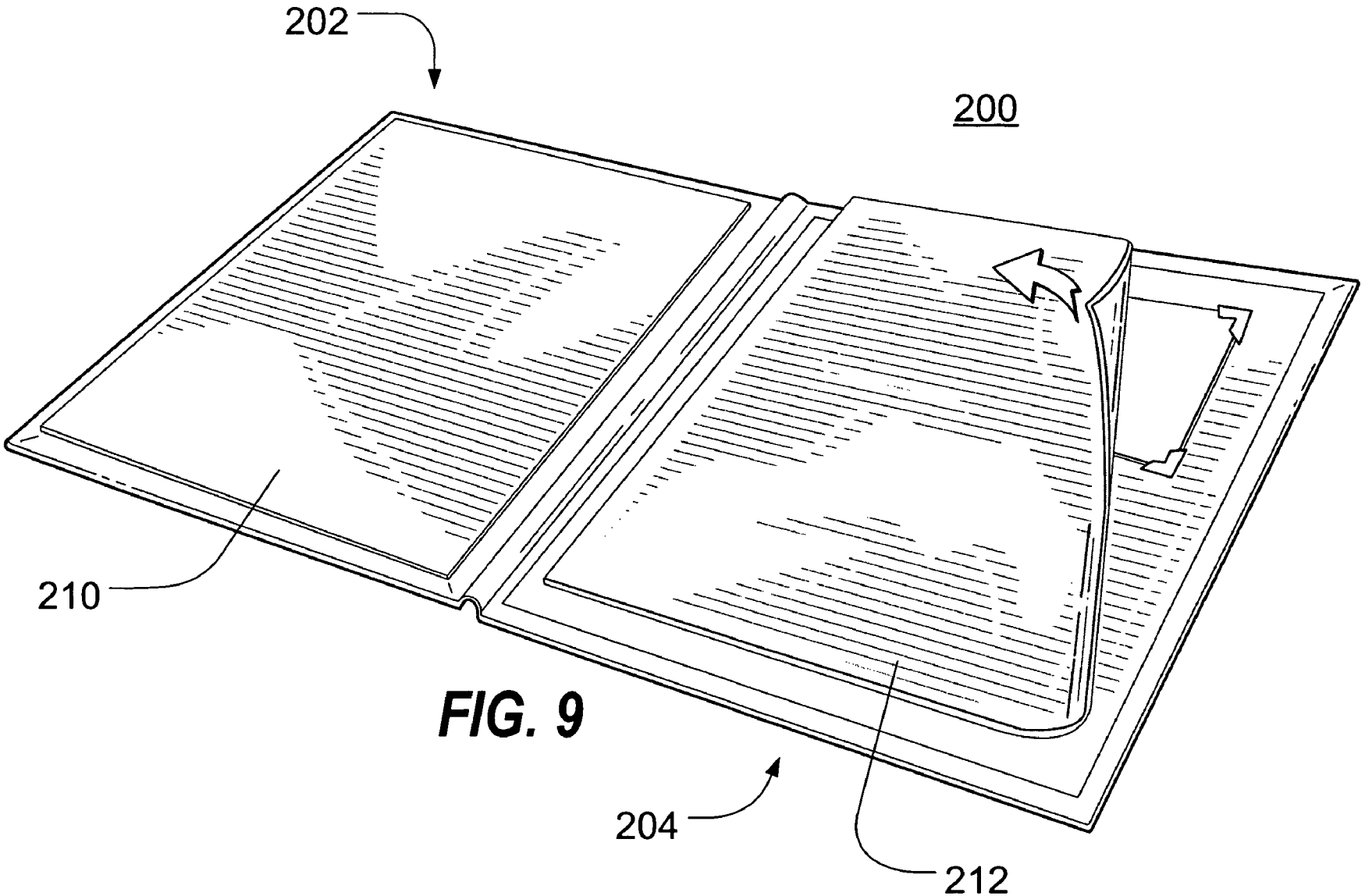
FIG. 9 illustrates another portfolio 200 in accordance with an embodiment of the invention.
Figure 10:
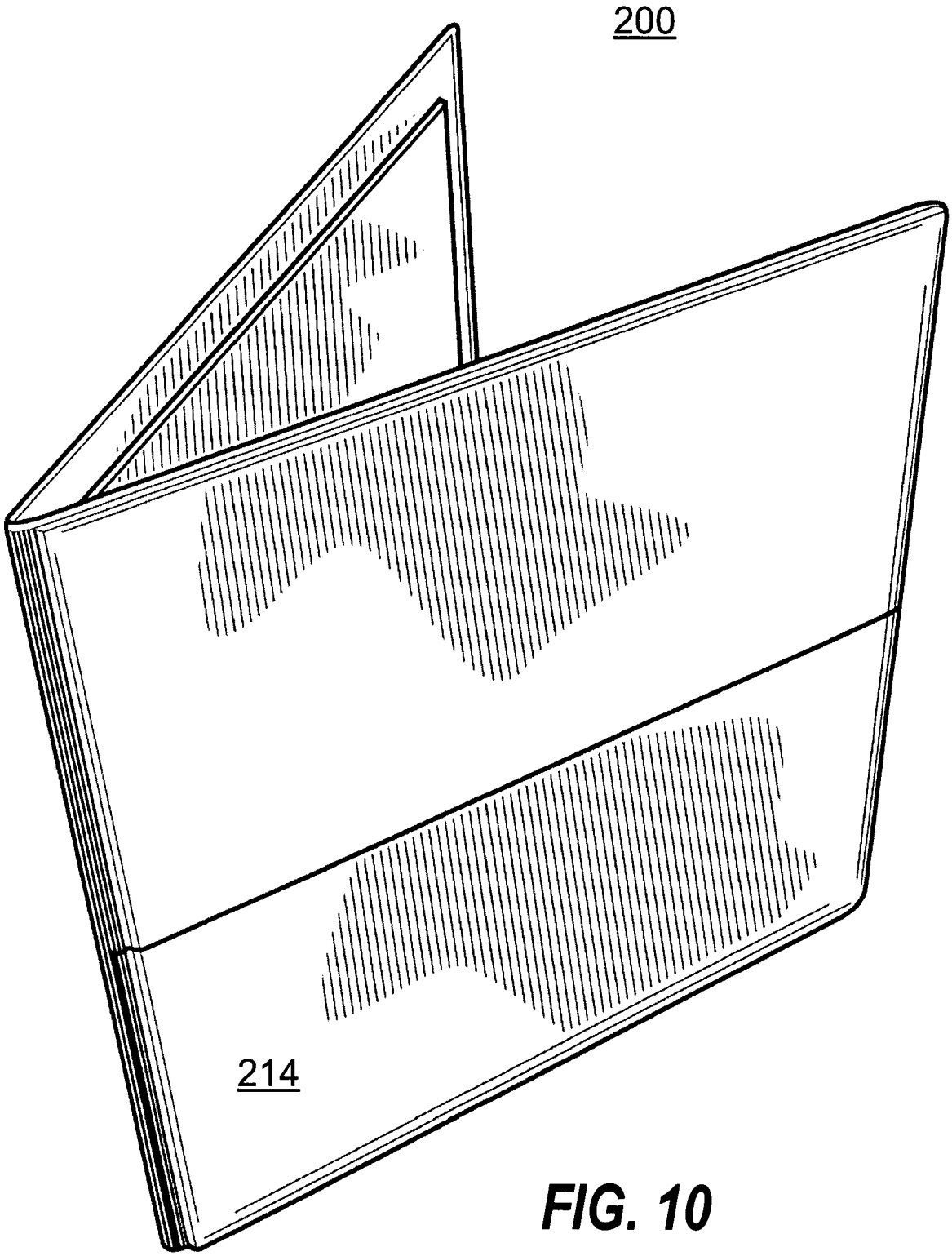
Figure 11:
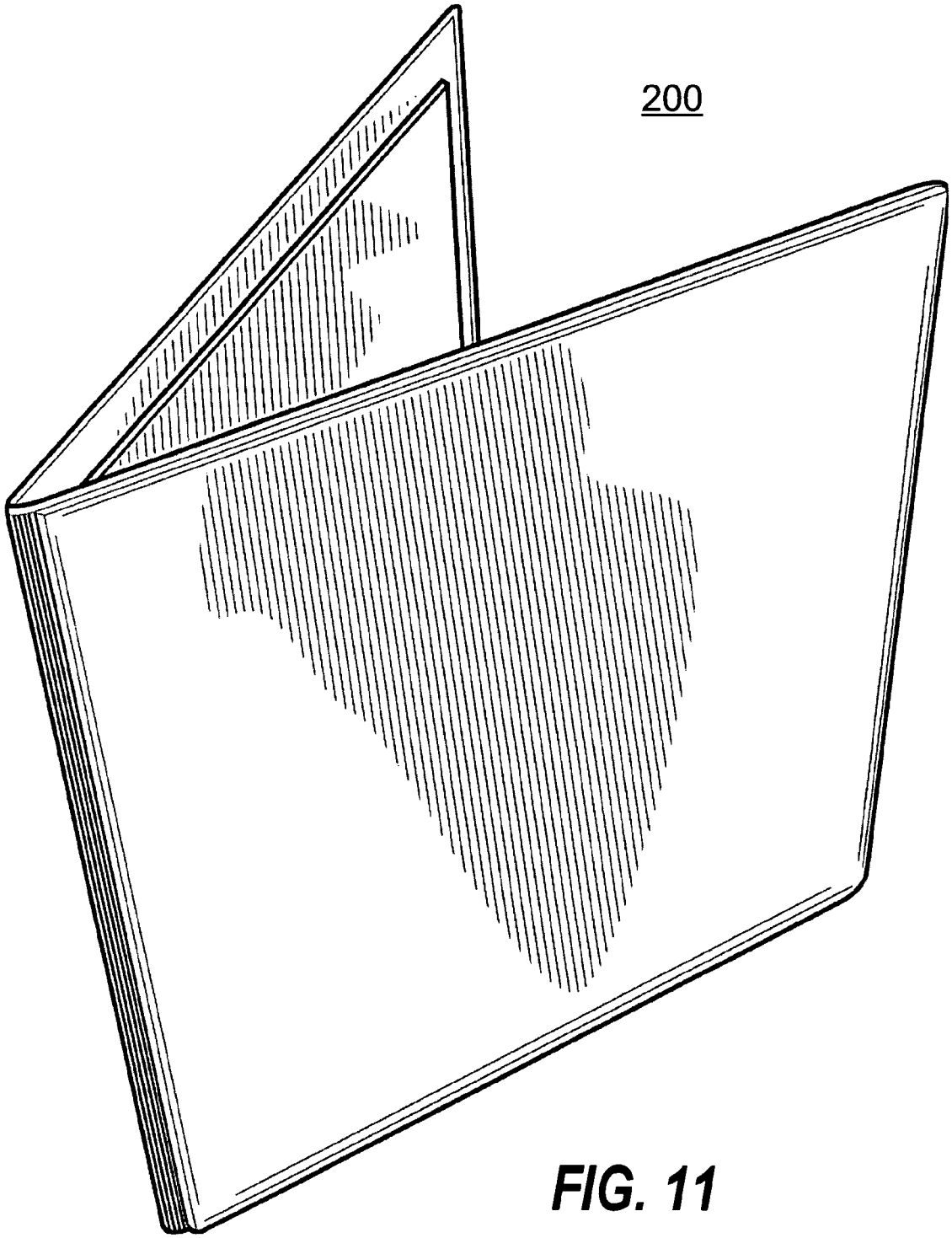

FIGS. 10 and 11 show further variations in an exterior of a cover 202,204 of the portfolio 200 of FIG. 9.

FIGS. 12-15 illustrate various sequences in working with the portfolio 200 of FIG. 9.

Figure 16:
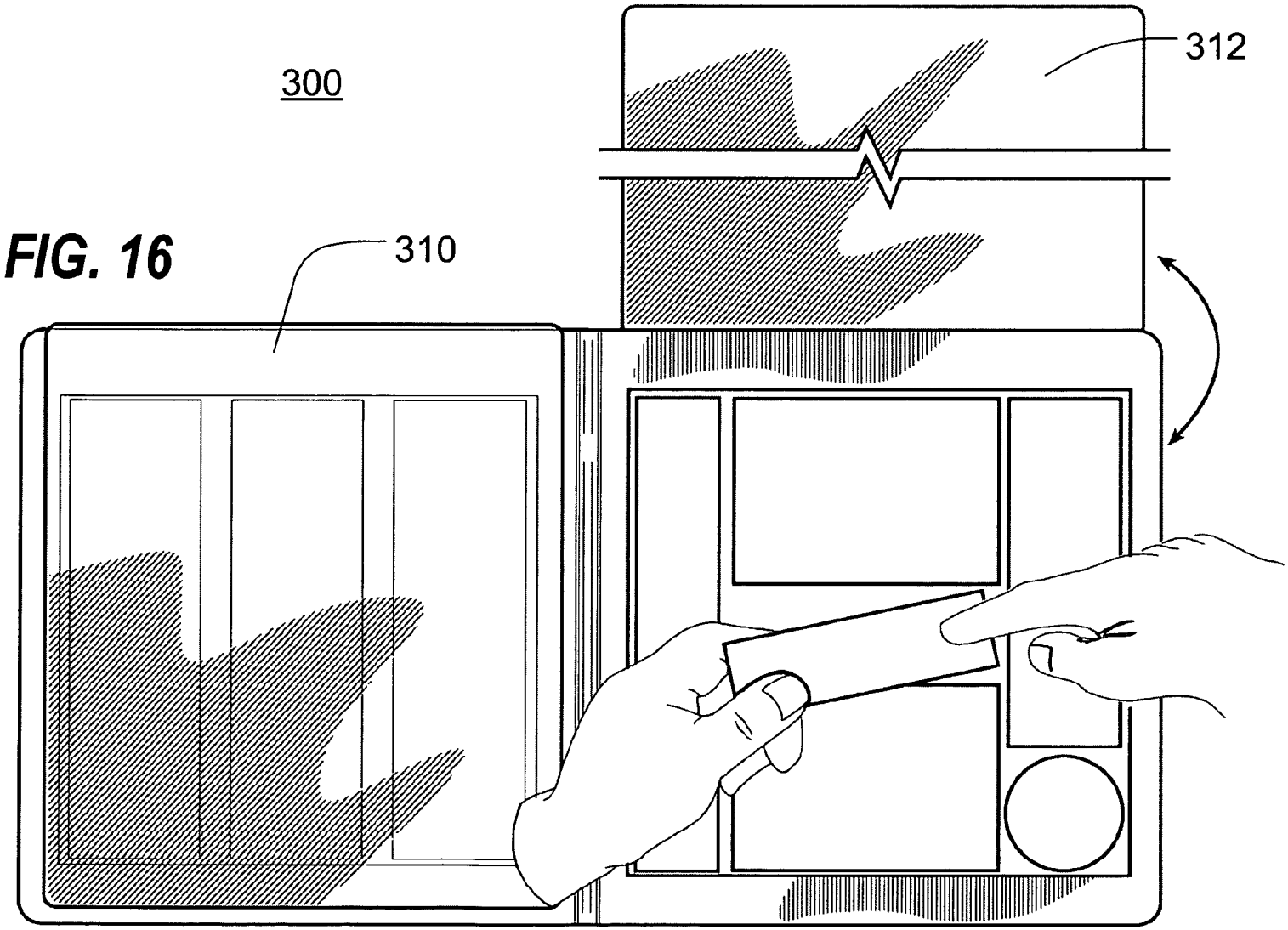
Figure 17:
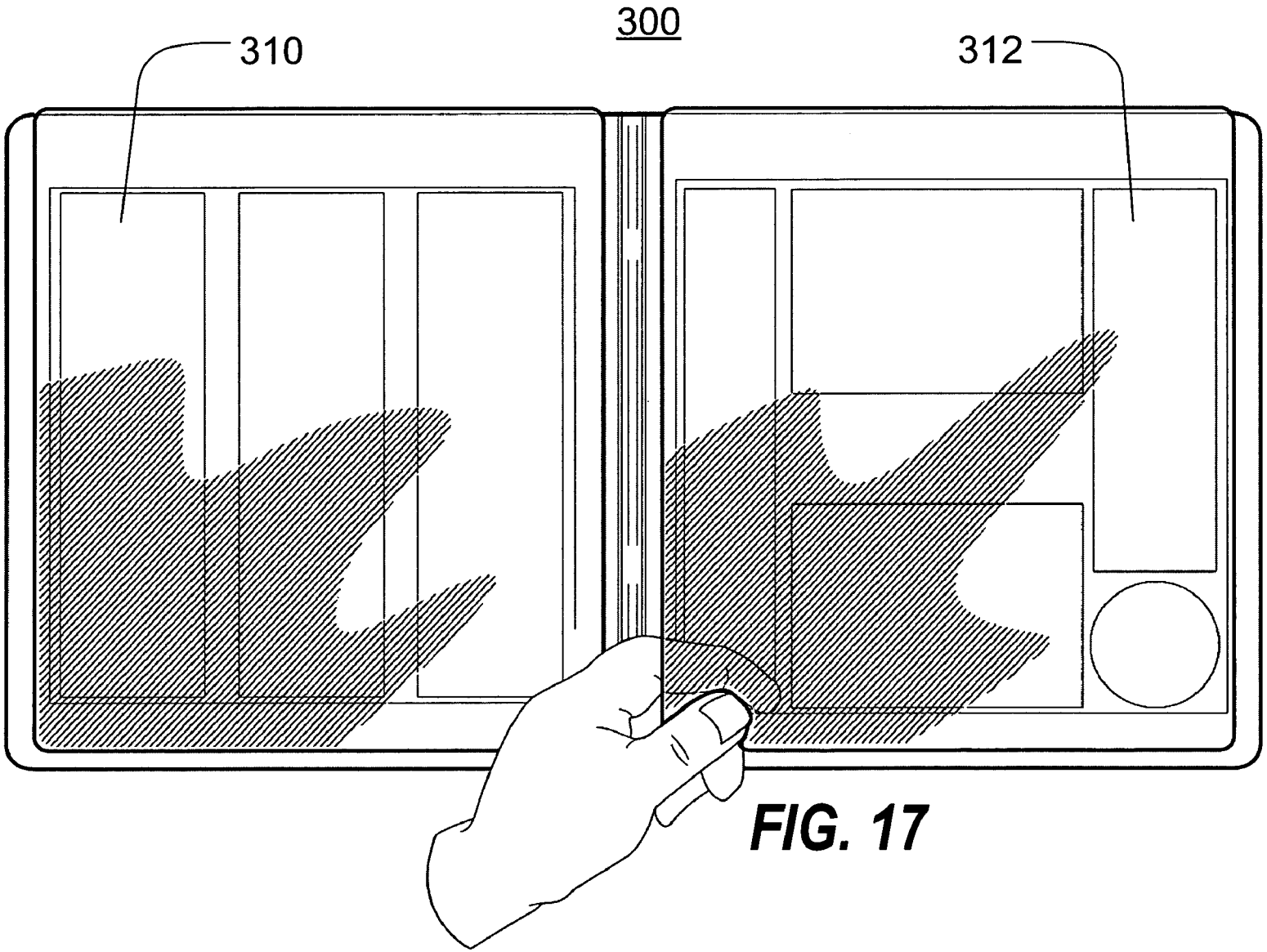

FIGS. 16-17 illustrate another portfolio 300 in accordance with an embodiment of the invention.

Figure 18:
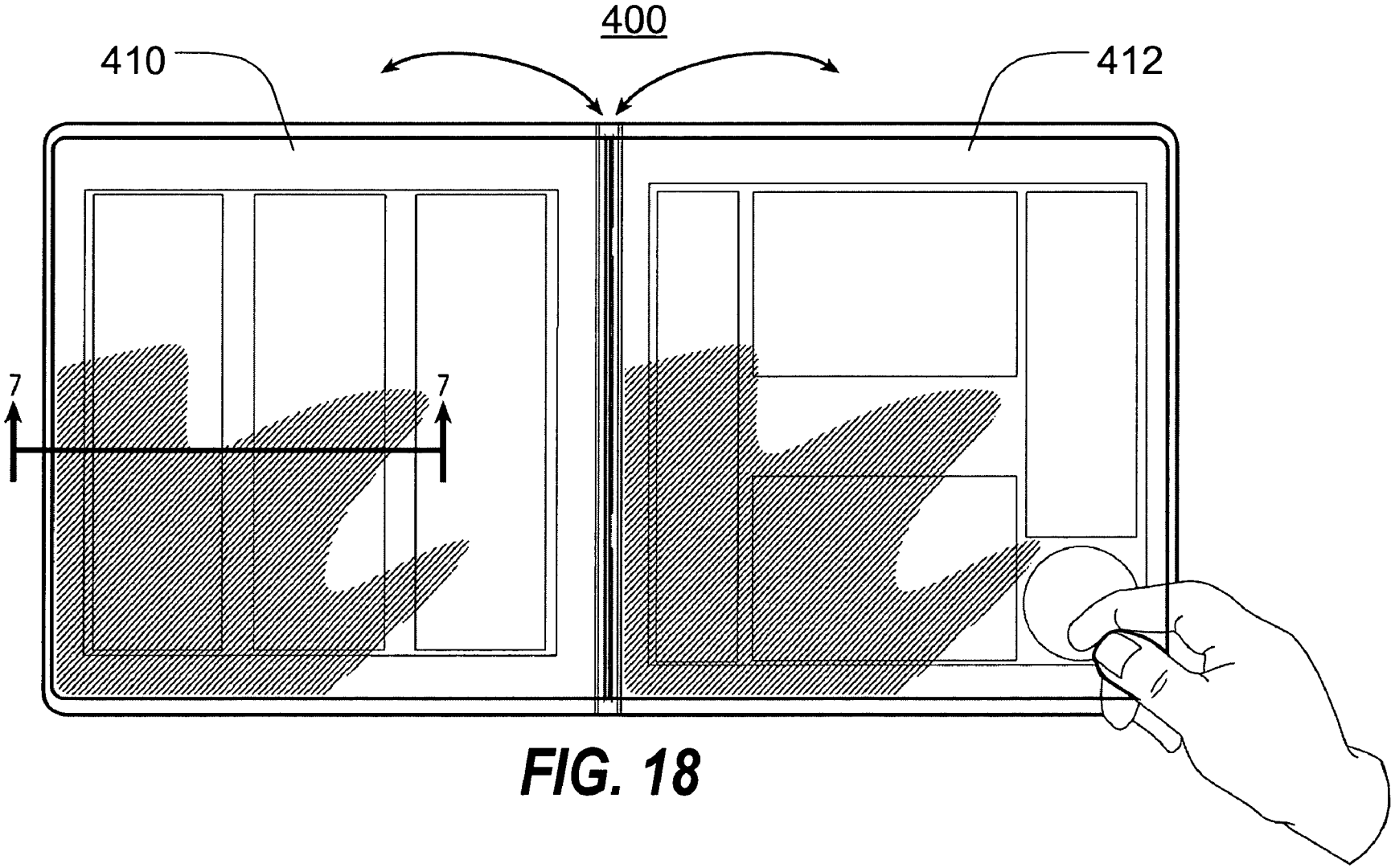

FIG. 18 illustrates another portfolio 400 in accordance with an embodiment of the invention.

Figure 19:
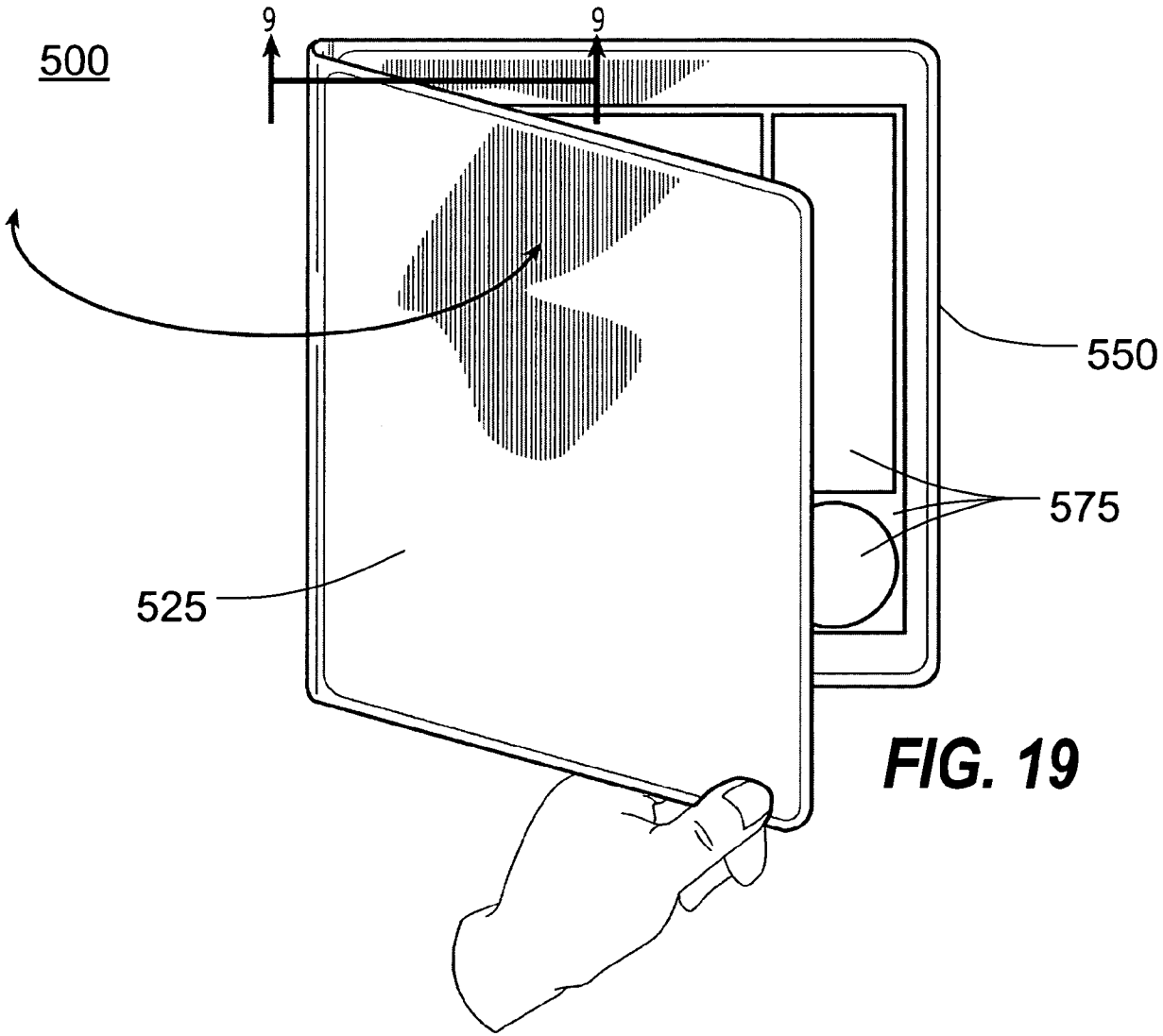
Figure 20:
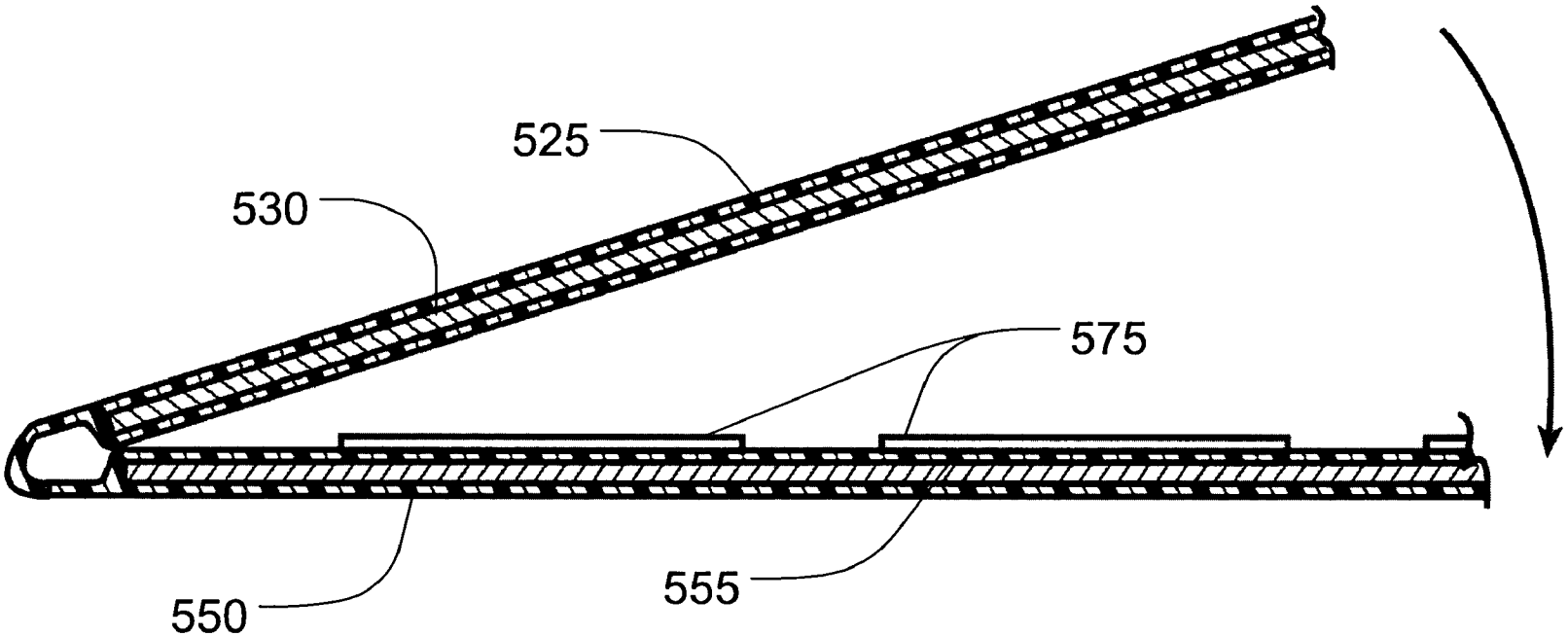

FIGS. 19-20 illustrate an apparatus 500 representing additional portfolios in accordance with additional embodiments of the present invention.

Figure 21:
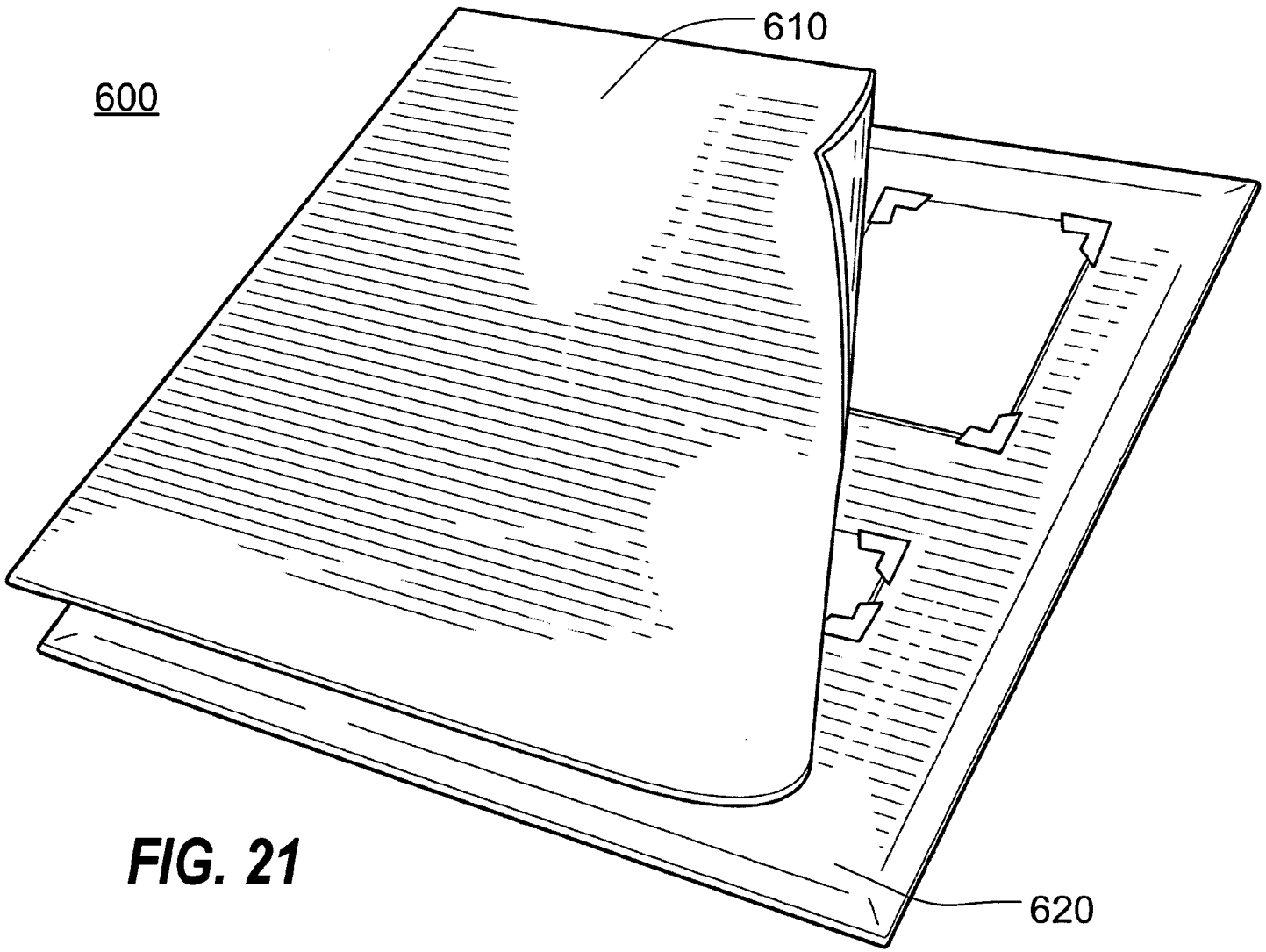
Figure 22:
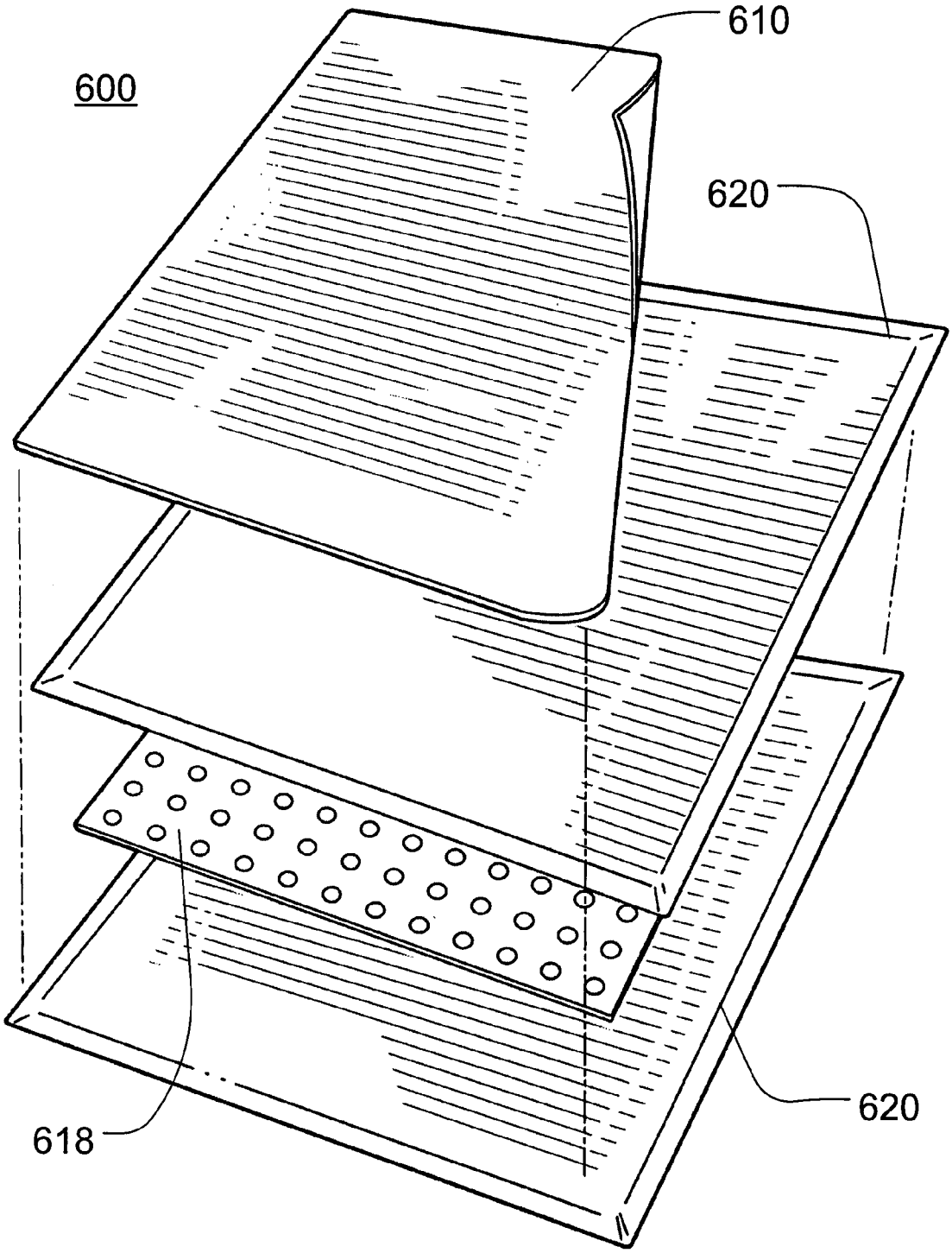

FIGS. 21-22 illustrate an apparatus 600 in accordance with another preferred embodiment of the present invention.

Figure 23:
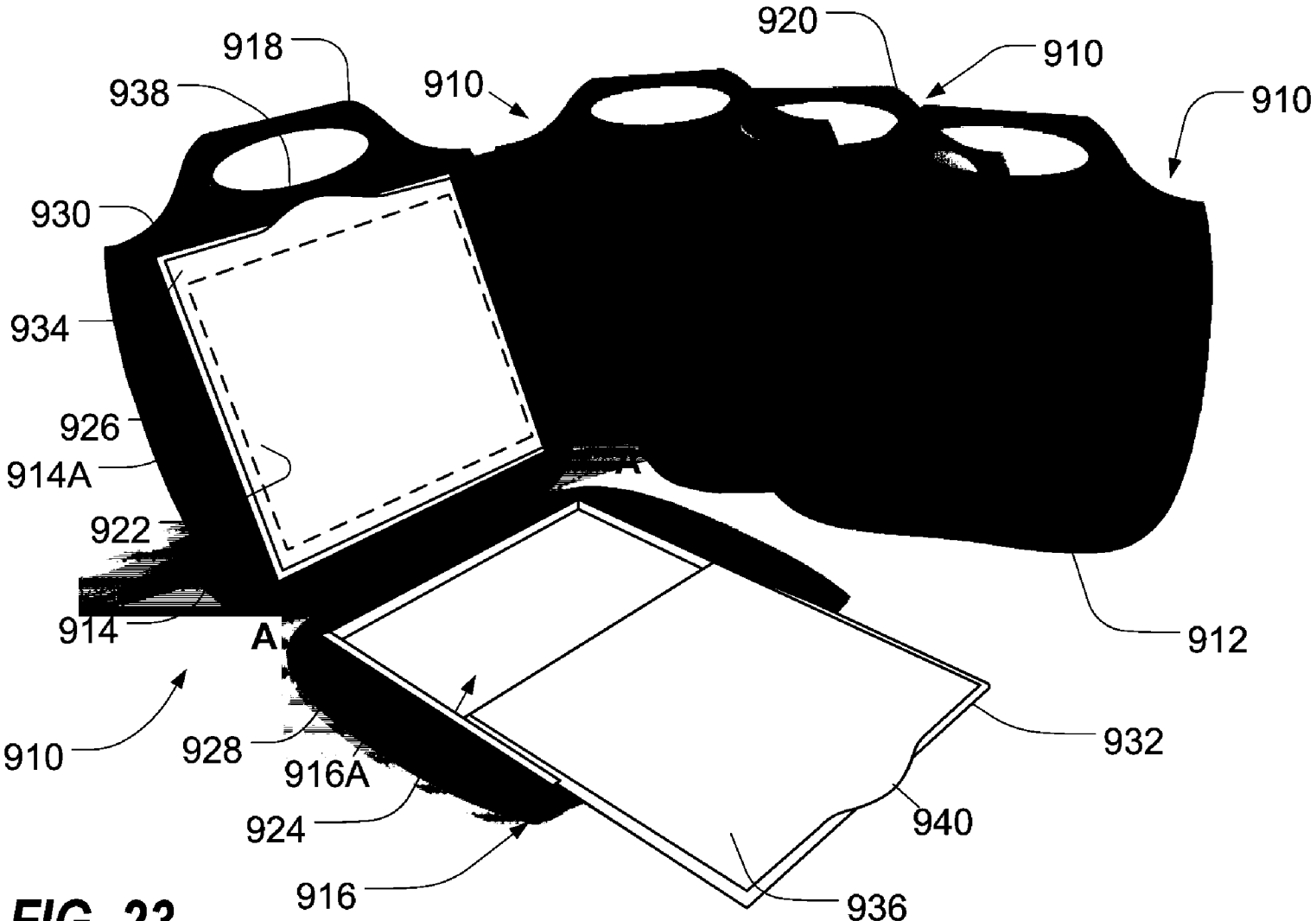

FIG. 23 illustrates yet another portfolio 910 in accordance with an embodiment of the present invention.

Figure 24:
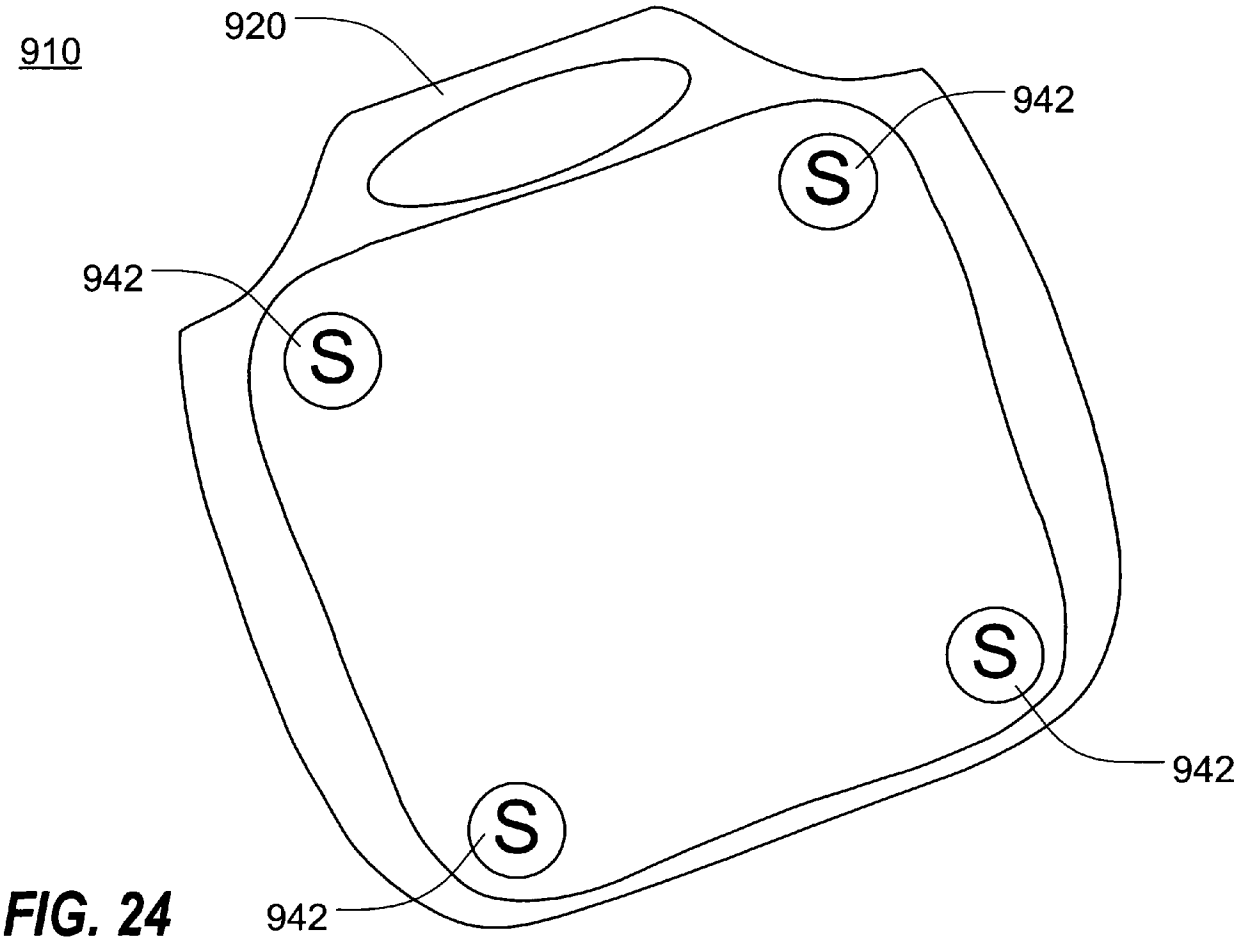

FIG. 24 feet of the portfolio 910 of FIG. 23.

VI. DETAILED DESCRIPTION

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of the preferred embodiment(s) is merely exemplary in nature and is in no way intended to limit the invention, its application, or uses.

Figure 1:
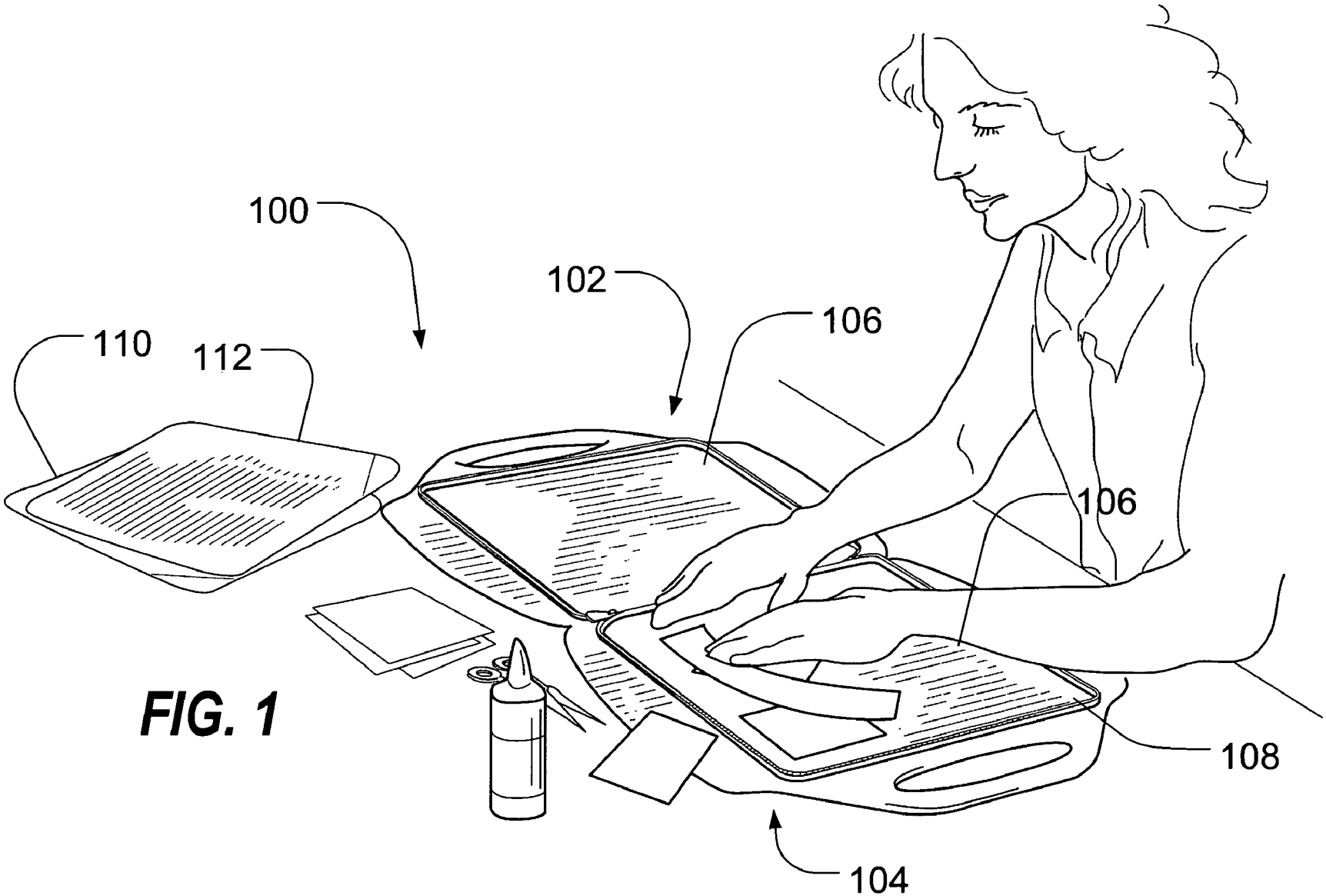

FIG. 1 is a perspective view of a scrapbooker using a portfolio 100 in accordance with a preferred embodiment of the present invention. The portfolio comprises a carrying case including two covers 102,104. The covers are bound to one another for hinging movement relative to each other and, when completely opened and resting upon a tabletop, the covers preferably lie generally flat as shown in FIG. 1.

Each cover 102,104 provides a clean, flat work surface 106,108 that is dimensioned to receive a scrapbooking page. For example, the work surface of each cover may be approximately twelve inches by twelve inches. While scrapbooking, the scrapbooker arranges different scrapbooking elements loosely on a scrapbooking page. The scrapbooker has placed a scrapbooking page on a work surface of a cover and is shown in FIG. 1 in the process of arranging scrapbooking elements on the scrapbooking page. The scrapbooker may try different arrangements of the scrapbooking elements before deciding upon a final, permanent arrangement.

The portfolio in accordance with the present invention also includes two overlays 110,112. The overlays each preferably comprise a thin and pliable metallic rubber sheet that may be further covered with a fabric. In particular, each overlay preferably is between one and two millimeters thick and is made from a rubber material that has iron filings incorporated therein and that is enclosed by a fabric. Such a material is well known and commonly used in the manufacture or magnetic dart boards, wherein the material is printed with the outline of a dart board and serves as the surface for receiving thrown darts having magnetic ends.

Figure 2:
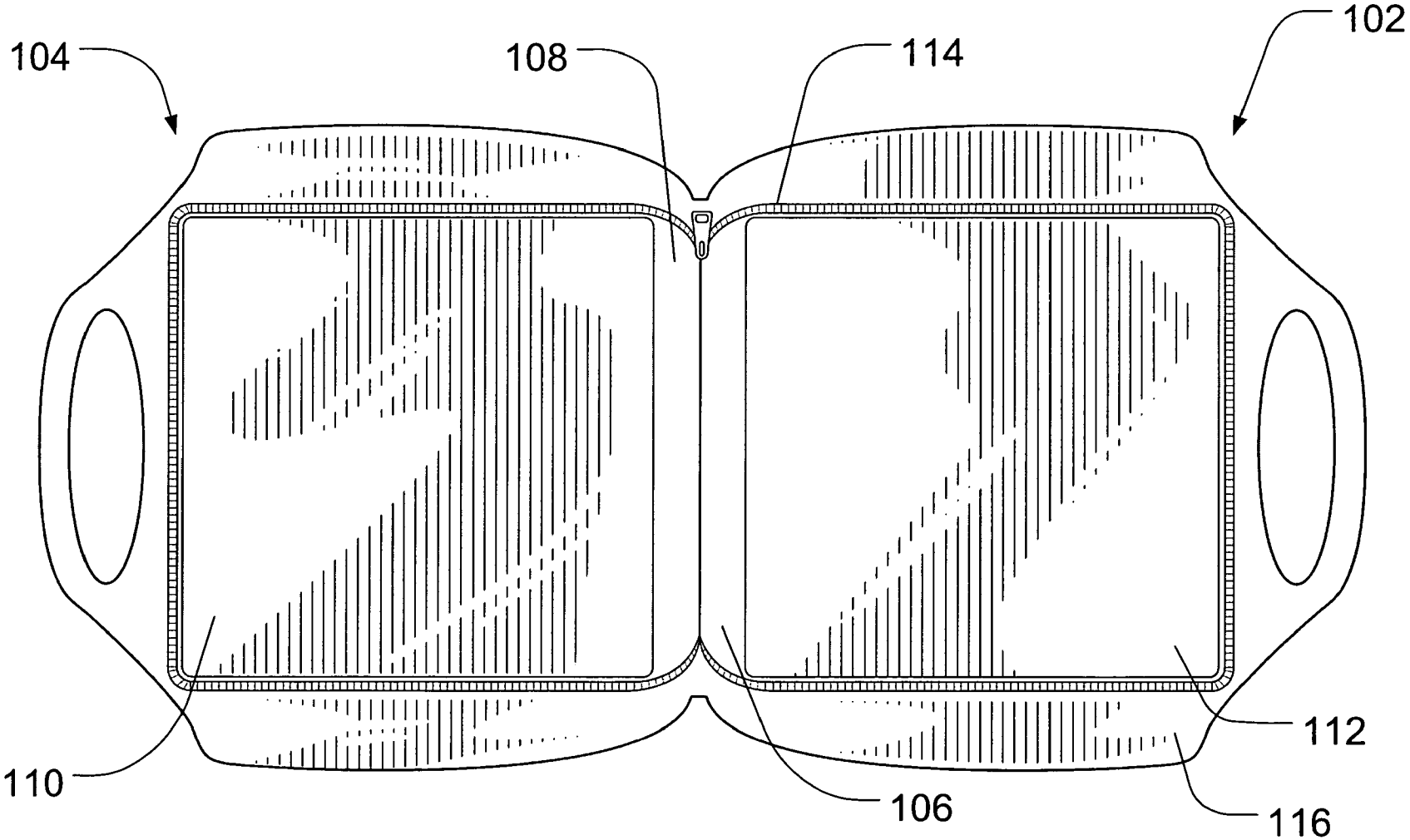

Each overlay is sized to cover a work surface of a cover of the portfolio. Each cover includes magnets therein for magnetically attracting the overlay, whereby the overlay is cohered to the work surface when the overlay is placed on top of the work surface in covering disposition of any scrapbooking page or scrapbooking elements loosely placed on the page. FIG. 2 is a top perspective view of the portfolio of FIG. 1 illustrating the overlays 110,112 cohered to the work surfaces 108,106 of the covers 102,104. Due to the cohesion, the scrapbooking page and scrapbooking elements are securely retained in fixed disposition relative to each other, even when the covers are brought together and the portfolio is closed. Accordingly, when a scrapbooking session ends, a scrapbooker may close and zip up the portfolio and carry the portfolio to another location or to a storage location until the scrapbooker is able to start another scrapbooking session.

As further illustrated in FIG. 2, the work surface is outlined on three sides by a closure feature that enables the portfolio to be securely closed when the two covers are brought together. It is preferred that the closure feature comprise a zipper 114. Each cover also includes a trim piece 116 outlining the closure feature. The trim piece also includes an opening that serves to define a carrying handle when the portfolio is closed.

Figures 3, 4:
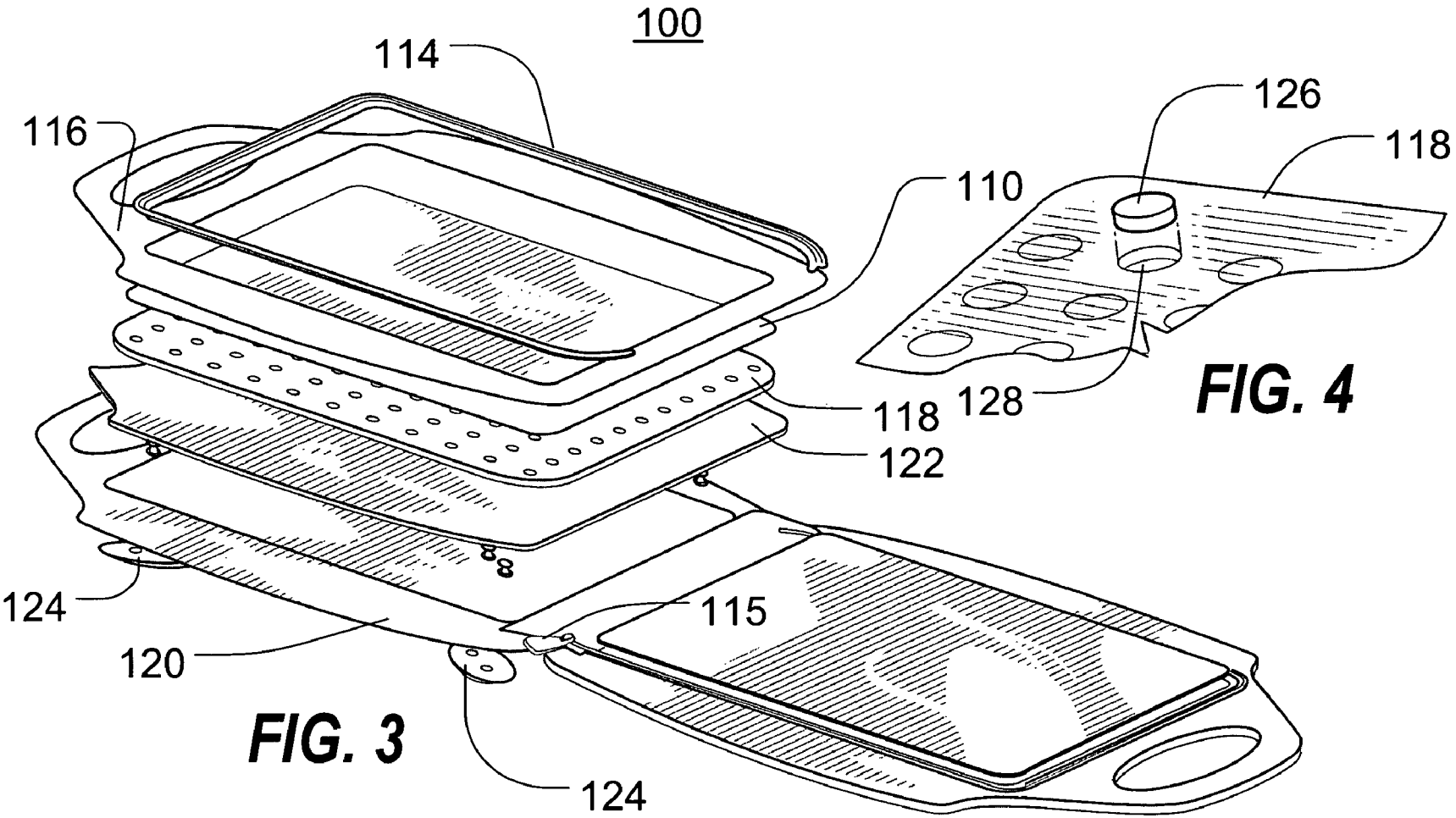
FIG. 3 shows an exploded view of the portfolio 100 of FIG. 2.
FIG. 4 is a partial view of a work substrate 118 of FIG. 3.
Figure 5:
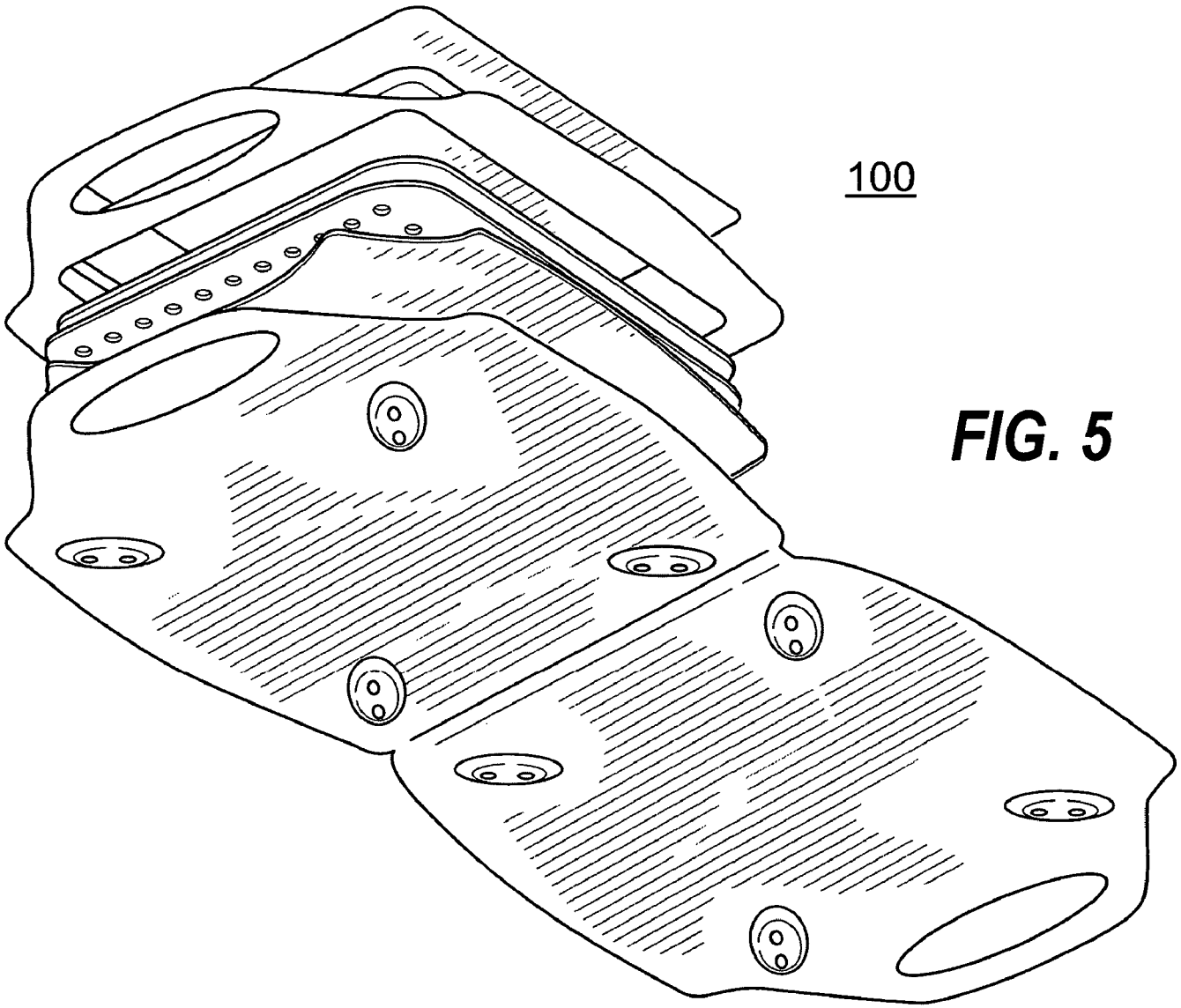
FIG. 5 shows another exploded view of the portfolio 100 of FIG. 2.

The construction and use of the portfolio is described further with reference to FIGS. 3-8 below. In this respect, FIGS. 3 and 5 show exploded views of the portfolio 100 of FIG. 2, and FIG. 4 is a partial view of a work substrate 118 of FIG. 3. FIG. 8 shows a bottom plan view of the portfolio 100 of FIG. 2.

The portfolio 100 includes an outer covering 120 that is preferably made of a durable, lightweight nylon fabric. More preferably the fabric is a textured nylon and, most preferably, the outer covering comprises a 500 denier urethane coated cordura. The portfolio includes a trim piece 116 that is essentially an inside surface of the carrying case and is therefore constructed of the same material as the outer covering. The trim piece includes an opening aligned with the opening of the outer covering for defining a handle for a scrapbooker transporting the portfolio.

The portfolio also includes a foam insert 122. The foam insert provides a padding that makes the portfolio more appealing to consumers. The foam also provides a barrier that is able to absorb or compensate for any abnormalities that are present on a surface on which the portfolio is placed. Preferably, the foam comprises 1.5# ester foam. Feet 124 formed from molded PVC also are provided on the outer covering of each cover for additional stability of the work surfaces during scrapbooking. The feet preferably are attached by rivets. The portfolio further includes a zipper 114. The zipper borders three sides of the work surfaces on each cover of the portfolio. The zipper also includes a zipper pull 115 and may be used to secure the covers of the portfolio together when the portfolio is closed.

In accordance with the preferred embodiment of the invention, the portfolio 100 includes a substrate 118 that is formed from a plastic material and that includes a matrix or array of magnets 126 disposed therein. The array preferably includes magnets that are an evenly spaced and symmetrical arranged such that a substantially uniform magnetic filed is provided proximate any area of the work surface. Subsequently, the iron filings in the overlay cause the overlay to be magnetically attracted to the work substrate when it is placed near the work substrate. Uniformity in the magnetic field across the substrate is believed to be important in order to create uniform cohesion by the overlay to the work surface. This generally insures that a loose scrapbooking element will be retained wherever it is located on the work surface.

As shown in FIG. 4, the substrate includes a matrix of circular openings 128 in which cylindrical magnets are received. It is further contemplated that a plastic coating may be disposed over the work substrate after the magnets have been placed in the apertures thereof to further hold the magnets in place. The substrate preferably is enclosed with nylon fabric, such as a 100 denier urethane coated ripstop.

The cylindrical magnets are arranged to provide a relatively constant magnetic field spanning across a surface of the work substrate. In the present embodiment, the magnets are round in shape and are sized slightly smaller than the round apertures in the work substrate. The magnets fit snuggly within the round apertures of the work substrate. In the present embodiment, the magnets are approximately 8 mm in diameter and 3 mm in thickness. It is also preferred that the magnets are rare earth permanent magnets. Exemplary rare earth permanent magnets include, but are not limited to, Samrium Cobalt SmCo magnets and/or Neodymium Iron Boron NdFeB N35 nickel plated magnets. The Ordinary Artisan will understand that other magnets also maybe utilized and that magnets of different shapes and disposed indifferent arrangements may be utilized as long as a generally uniform magnetic field is provided for the surface of the work substrate. For instance, it is explicitly contemplated that bar magnets having a thickness of approximately 3 millimeters could be arranged in concentric rectangles in accordance with the present invention.

Figure 6:
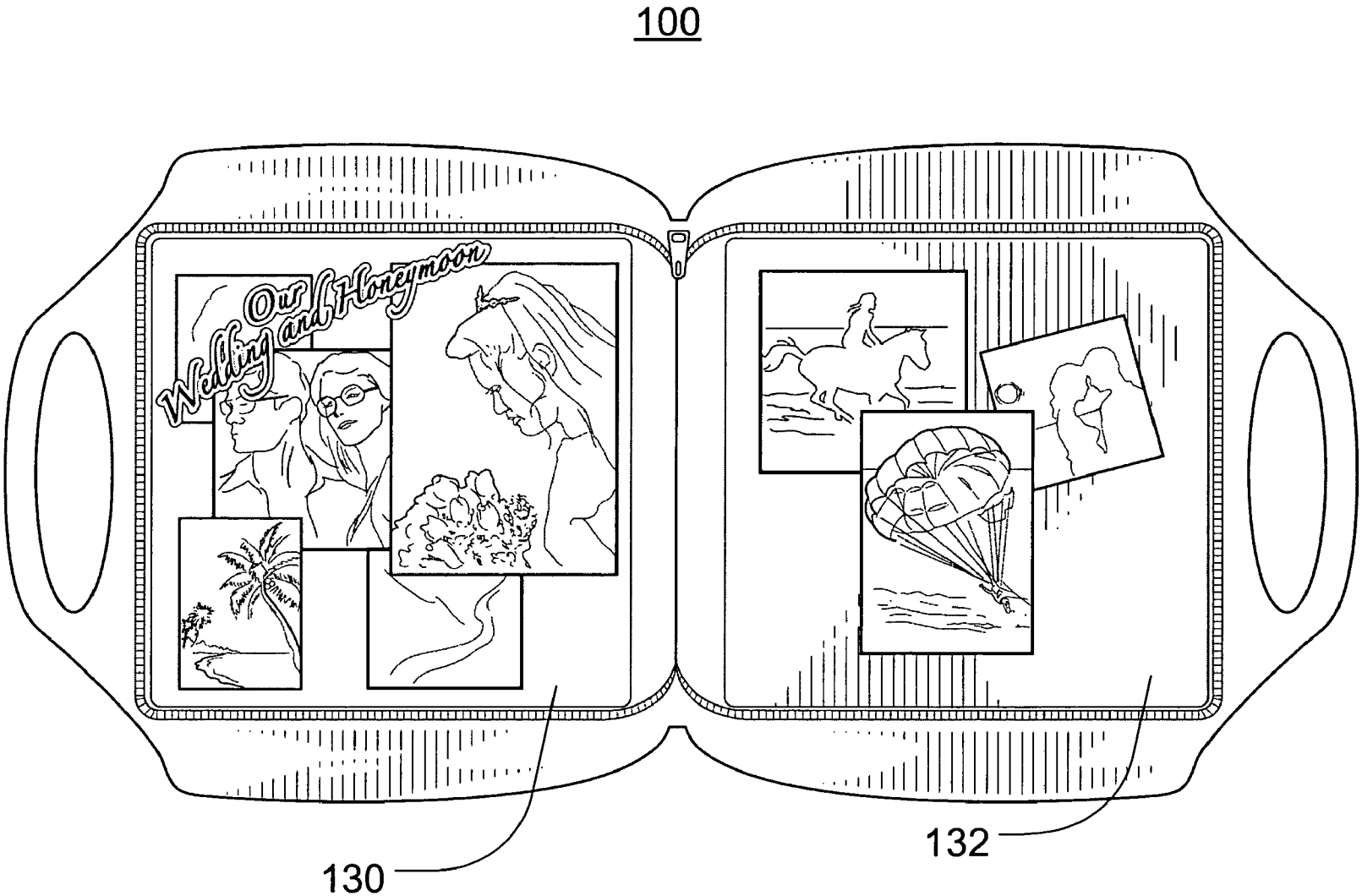
FIGS. 6 and 7 illustrate a beneficial use of the portfolio 100 in accordance with the present invention.
Figure 7:
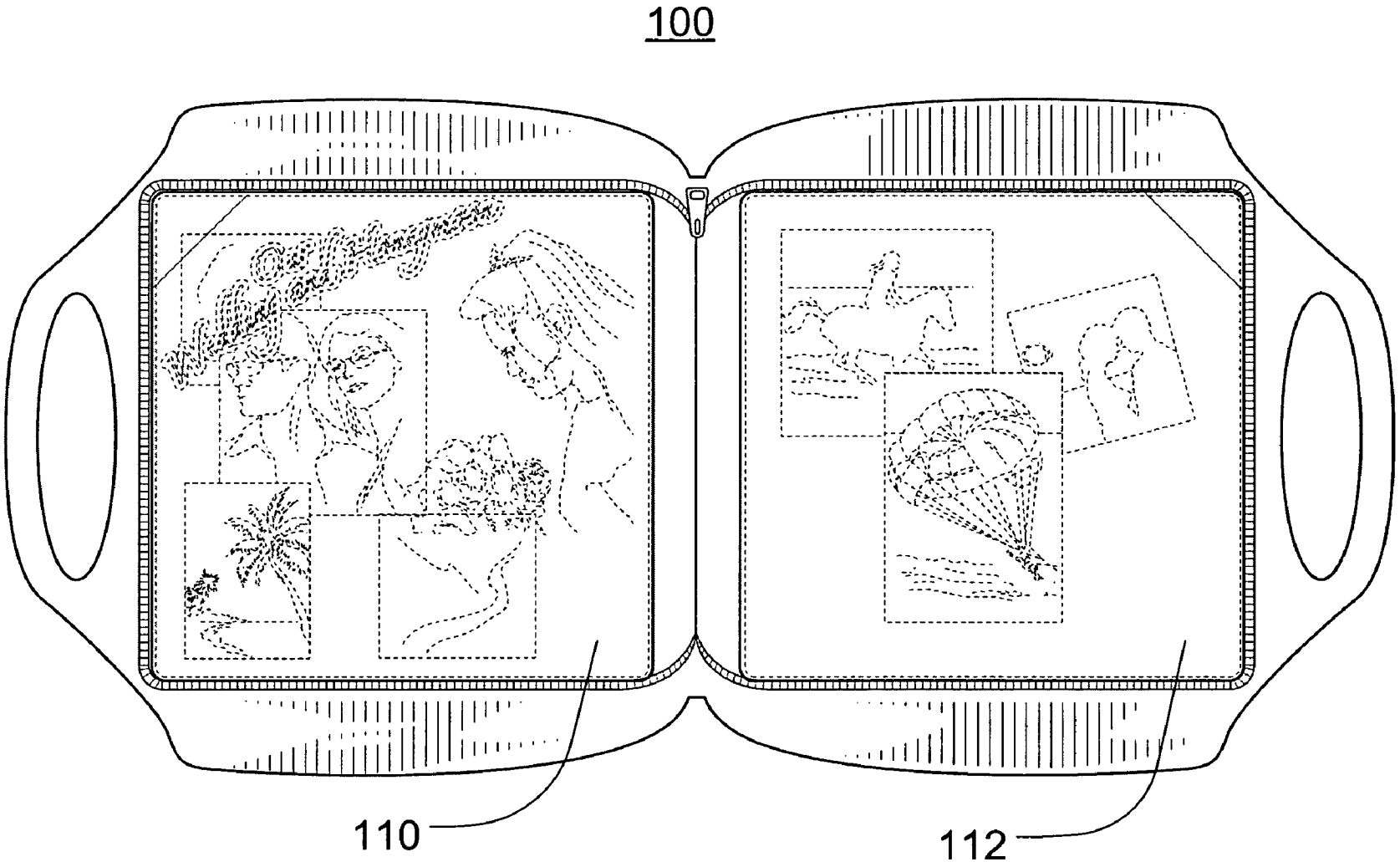
Figure 8:
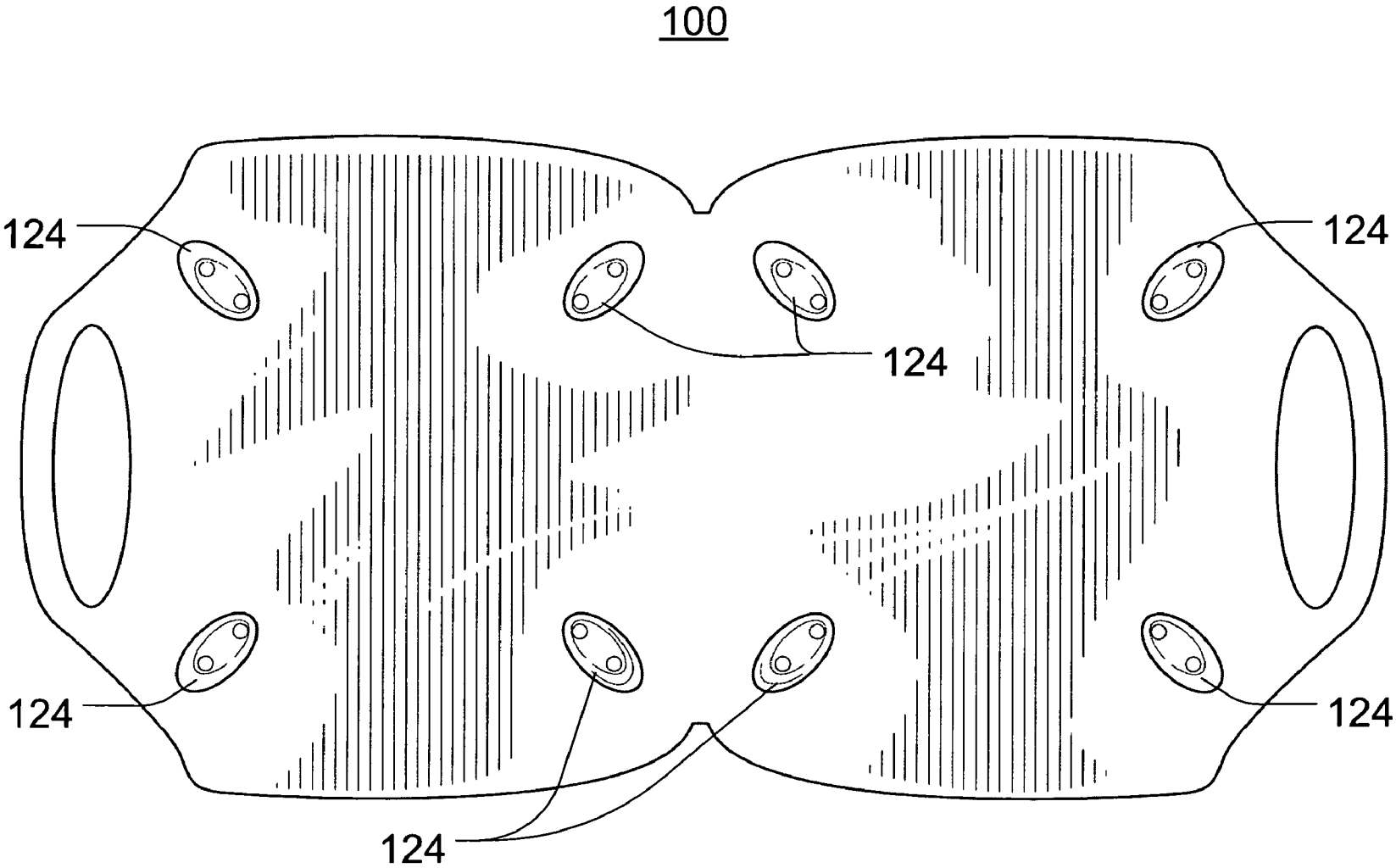
FIG. 8 shows a bottom plan view of the portfolio 100 of FIG. 2.

FIGS. 6 and 7 serve to clearly illustrate the benefit of the portfolio in accordance with the present invention. In FIG. 6, scrapbooking elements are arranged loosely on two scrapbooking pages 130,132 and work in conjunction with one another and are coordinated to present memories of a honeymoon. FIG. 7 illustrates overlays 110,112 cohered to the work surfaces of the portfolio thereby affixing the scrapbooking pages and scrapbooking elements (shown in phantom) in fixed disposition between the overlays and the work surfaces.

FIG. 9 illustrates another portfolio 200 in accordance with an embodiment of the invention that is similar to the portfolio 100 of FIGS. 1-8. In this respect, the portfolio includes two covers 202,204 that are bound together for hinging movement and overlays 210,212 that cohere to the work surfaces of the covers. FIG. 9 further illustrates the preferred pliable nature of the overlay as it is being peeled away from the work surface without disturbing any loose scrapbooking elements that might be located therebeneath. The portfolio differs from that of FIGS. 1-8 in that the portfolio includes a simpler version that does not include, for example, a zipper closure, trim, foam, or feet. Optionally, the portfolio also may include a thin steel sheet enclosed within each cover and a magnetic material forming the overlay rather than the metallic rubber sheet as found in the preferred portfolio of FIGS. 1-8.

FIGS. 10 and 11 show further variations in an exterior of a cover 202,204 of the portfolio 200 of FIG. 9. In FIG. 10, the covering forms a pocket 214 therein for storage of a few paper items or scrapbooking elements, and in FIG. 10, no pocket is provided in the outer surface of the cover.

Figure 12:
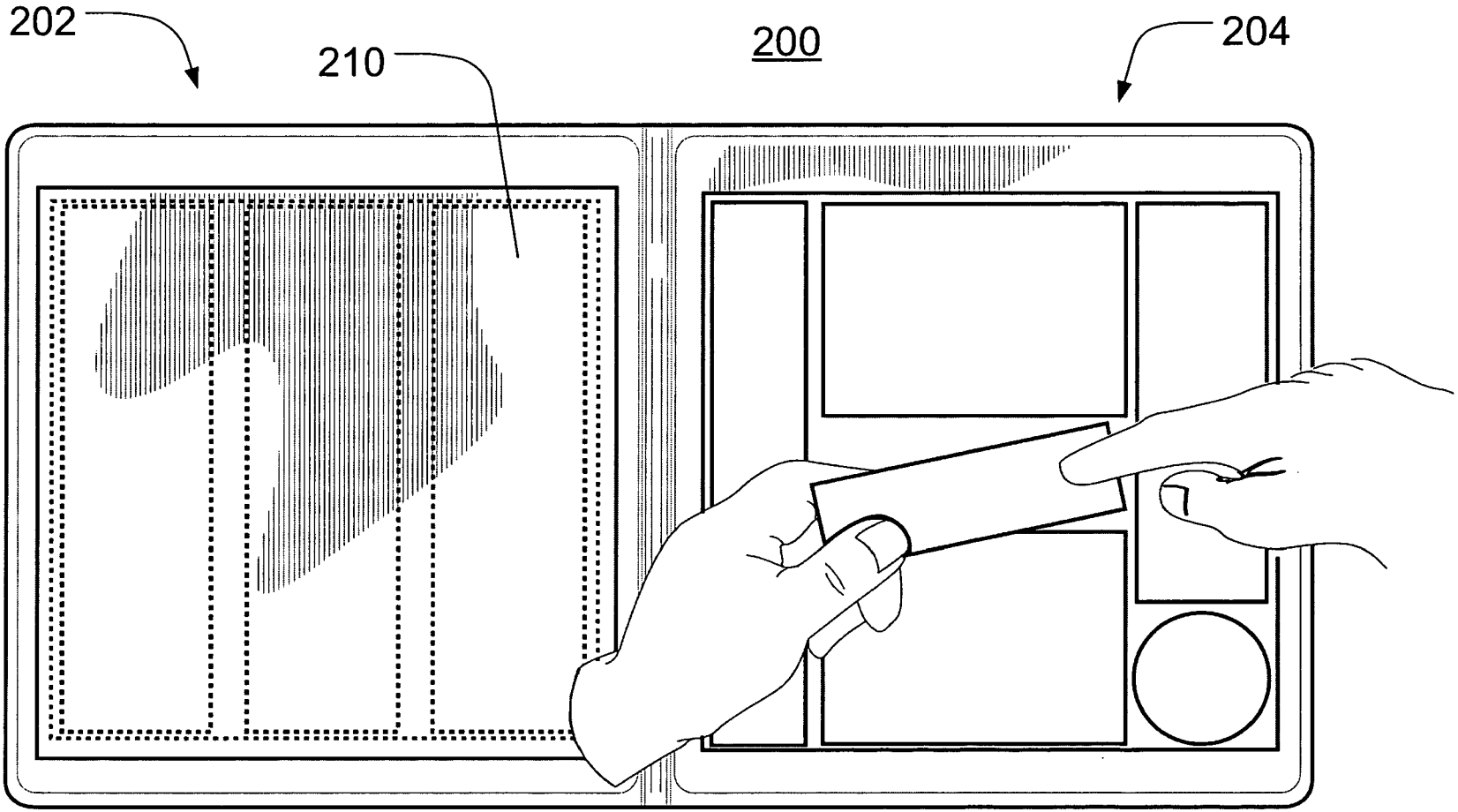
Figure 13:
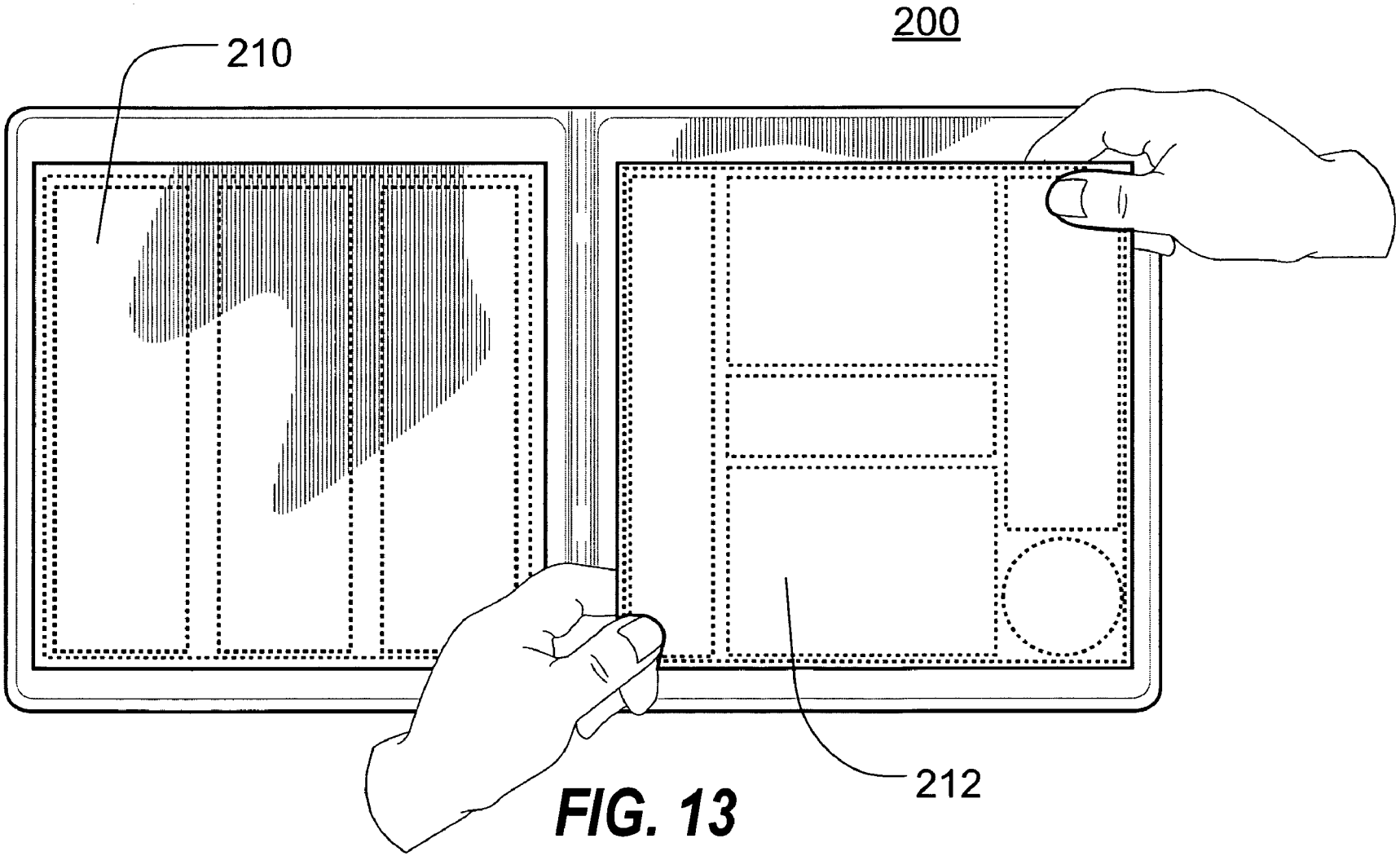
Figure 14:
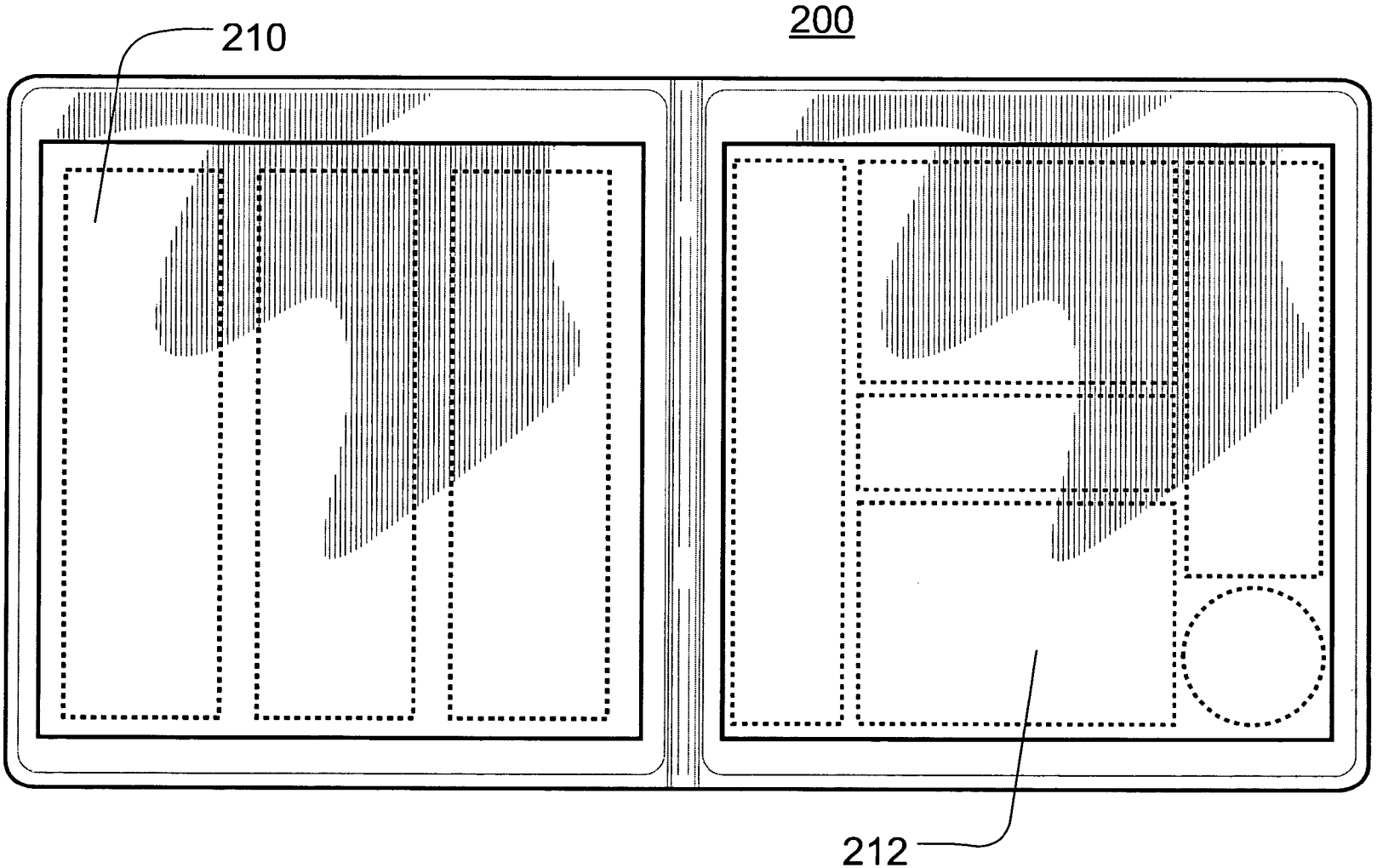
Figure 15:
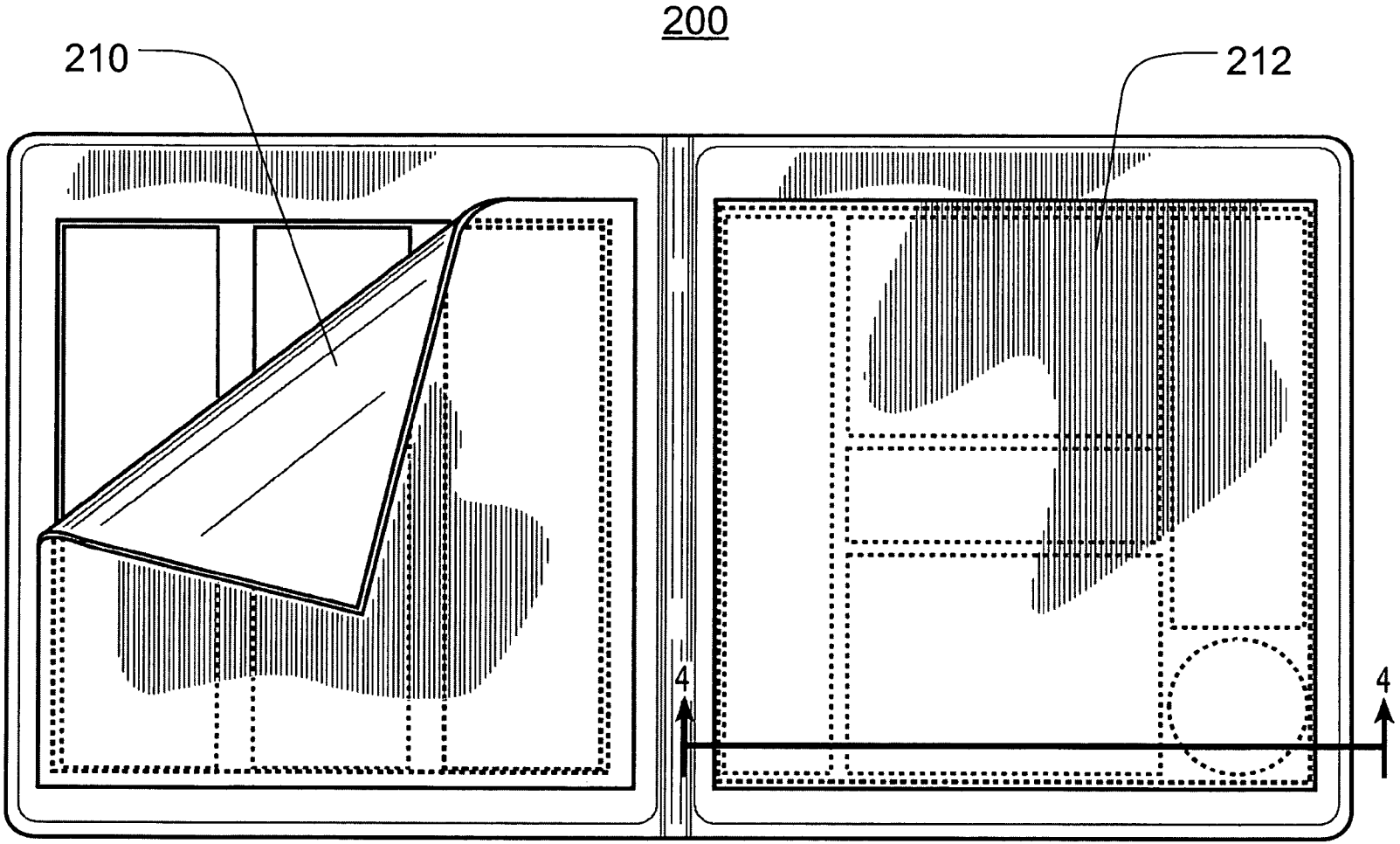

FIGS. 12-15 illustrate various sequences in working with the portfolio 200 of FIG. 9. In FIG. 12, a scrapbook page and three scrapbooking elements thereon are safely retained in position on the work surface of a cover 202 of the portfolio by overlay 210 while a loose arrangement of scrapbooking elements is being laid out on the work surface of the other cover 204 of the portfolio. In FIG. 13, an overlay 212 is positioned over the new arrangement of loose elements for preserving the arrangement. FIG. 14 illustrates the overlays 210,212 retaining respectively retaining the loose arrangements in fixed disposition, and FIG. 15 illustrates the removing the overlay 212 for further work on the loose arrangement of the three scrapbooking elements on the scrapbooking page without disturbing the other arrangement of loose elements being retained by overlay 110.

FIGS. 16-17 illustrate another portfolio 300 in accordance with an embodiment of the invention. The portfolio 300 is similar to the portfolio 200 of FIG. 9 except that each overlay 310,312 is physically bound to a respective cover for hinging movement relative thereto. In particular, each overlay is shown as bound to the top of each cover, whereby the overlay may be folded upwardly relative to the work surface when an arrangement to be laid out, as shown in FIG. 16, and then lowered into retaining disposition over the arrangement when the arrangement is to be preserved, as shown in FIG. 17.

FIG. 18 illustrates another portfolio 400 in accordance with an embodiment of the invention that is similar to the portfolio 300 of FIGS. 16-17 except that each overlay 410,412 is physically bound to a respective interior side of a cover for hinging movement relative thereto rather than to an exterior side of the covers as previously shown in the portfolio 300 of FIGS. 16-17.

Other possible embodiments of a portfolio in accordance with the invention includes two covers that are magnetically attracted to each other; or an overlay and a cover that are bound to each other and that are magnetically attracted to each other. These embodiments are represented in FIGS. 19-20, wherein a portfolio 500 includes a first member 525 (representing either an overlay or a cover) that is pivotally attached to a second member 550 that includes a work surface with a scrapbook page and elements 575. The first member 525 includes a first interior layer 530 and the second member 550 includes a second interior layer 555 that are magnetically attracted to one another, whereby upon bringing the two members 525,550 into covering disposition relative to one another, a magnetic force arises that holds the two members 525,550 in said disposition and serves to retain in fixed disposition the scrapbooking page and scrapbooking elements 575 disposed therebetween.

While the foregoing description thus far has disclosed portfolios, i.e., apparatus in which two members are connected or bound together for hinging movement relative thereto, it should be apparent that the present invention also works with a single work surface. Accordingly, an apparatus 600 in accordance with another preferred embodiment of the present invention is illustrated in FIGS. 21-22 and includes a work substrate 618 similar to substrate 118 that is enclosed in an outer covering 620 similar to the outer covering 120. An overlay 610 similar to overlay 110 is used to retain an arrangement of scrapbooking elements on a scrapbooking page in similar manner to the use of either overlay 110,112. Moreover, a second overlay (not shown) may be used to retain another arrangement of scrapbooking elements on a scrapbooking page on the other side (not shown) of the apparatus 600, if desired. The drawback to using apparatus 600 to retain two layouts is that both layouts cannot be simultaneously worked on in conjunction with one another.

In alternative embodiments (not shown), overlays may have other various sizes than a size corresponding to work surface. In such embodiments, more than one overlay may be used in conjunction with a work surface for retaining scrapbook elements, as desired.

Exterior surfaces of portfolio and/or the overlays further may include customized indicia and/or advertisements relating to scrapbooking. Logos, for example, can be printed or imprinted onto the covers and/or the overlays.

A small sleeve (not shown) also may be provided in which a portfolio such as that of FIG. 9 is placed for transport and/or storage. The sleeve preferably protects the portfolio and keeps the portfolio in the closed position. The sleeve further may include customized indicia and/or advertisements relating to scrapbooking.

As shown in FIG. 23, yet another embodiment of a portfolio of the present invention, generally designated 910, includes a carrying case 912 having two clam shell shaped, mirror image halves 914,916, each featuring a respective trim piece 914A,916A and pivotally hinged about a hinge line A. The portfolio 910 includes a closure feature, preferably a magnetic closure, which releasably couples the two halves 914,916 together along three edges of the carrying case 912. In this regard, magnets (not shown) preferably are enclosed by the interior of the trim pieces 914A,916A and serve to retain the carrying case 912 in its closed position during storage and transportation. The trim pieces 914A,916A also provide integral carrying handles 918,920 and may include a substantially rigid structure enclosed by the trim pieces in the area of the handles 918,920 for structural support in defining openings in the handles 918,920.

The clam shell design of the two halves 914,916 allows for a pair of opposing storage compartments 922,924. The storage compartments 922,924 each comprise a respective inner liner 926,928 and are made of a rigid plastic material. Each of the inner liners 926,928 includes a frame defined by tracks that are disposed on three sides of the perimeter of the inner liner. Each track slidably receives a portion of the periphery of a respective work surface 930,932. The slidable work surfaces 930,932 are dimensioned to fit the frames defined by the tracks. Releasably cohered with the work surfaces 930,932 are corresponding overlays 934,936 such that each overlay 934,936 may be removed from its respective work surface 930,932 without substantially altering or disrupting any arrangement of loose items or elements disposed between the overlay and work surface, including a scrapbooking page when a scrapbooking page is disposed between the work surface 930 or 932 and the corresponding overlay 934,936. To facilitate such removal, each of the overlays 934,936 comprises a respective lifting tab 938,940, disposed preferably in the middle of one of the four edges of the respective overlay 934,936, for easy peel-off from the work surface 930,932 and any draft scrapbooking page and elements disposed there between.

As best seen in FIG. 24, rubber feet 942 are also preferably disposed on the exterior sides of the two clam shell-shaped halves 914,916, with each rubber foot 942 being located in a corner. Each foot 942 preferably is removable from its clam shell-shaped half 914,916, and each rubber foot 942 preferably includes molded or otherwise formed therein indicia and/or advertisements relating to scrapbooking, such as logos and trademarks. The rubber feet 942 facilitate the adherence of the carrying case 912 to the work area such as a table during scrapbooking.

The clam shell-shaped halves 914,916 preferably are made by thermoforming processes and comprise materials such as synthetic suede or closed cell foam in any desired color. Moreover, the edges of each clam shell-shaped half 914,916 preferably is trim punched after thermoforming to provide for different portfolio profiles, shapes and/or styles, as desired. Thus, edges of the portfolio readily could be manufactured with a wave-shaped design, a jagged edge design, a lattice design, and the like without otherwise altering the manufacturing process and, specifically, without necessarily altering the thermoforming processes.

The inner liners 926,928 are substantially rigid. They may be fabricated in any conventional manner of materials conventionally used for storage of unused scrapbooking elements or other items. Preferably, the inner liners 926,928 are formed in molding processes.

The overlays 934,936 may be opaque or entirely opaque and includes no clear, translucent portions. Preferably, the overlays 934,936 and the work surfaces 930,932 are releasably cohered together by magnetic forces. In this respect, the overlays 934,936 may includes a magnetic material and the work surfaces 930,932 may include: a magnetic material; a ferromagnetic material; or a paramagnetic material. Preferably, each work surface 930,932 includes a thin steel sheet disposed within an exterior vinyl covering. Moreover, the overlays 934,936 may include a magnetic material; a ferromagnetic material; or a paramagnetic material. In this regard, the overlays 934,936 may include a steel sheet disposed within a vinyl exterior covering.

In some embodiments, the portfolio may resemble a woman's purse.

Each work surface 930,932 presents a sufficient work space to surround a scrapbooking page and each overlay 934,936 is dimensioned preferably to completely overlay a scrapbooking page when placed onto the work surface 930, 932. The overlays 934,936 preferably are slightly smaller in size than the work surfaces 930,932 for easy removal from its cohesion with the work surface 930,932 without substantially altering or disrupting the arrangement of any loose items or elements disposed there between, with the work surface 930, 932 being received and retained within the frame (tracks) of one of the inner liners 926,928.

In accordance with the invention, an overlay coheres to a work surface 930,932, and the draft scrapbooking page and any loose elements placed thereon are retained in their original disposition until the overlay 934,936 is removed from the cover. By cohering the overlay 934,936 and work surface 930,932, the arrangement of loose elements on the scrapbooking page is preserved until the next scrapbooking session. In alternative embodiments, the overlays 934,936 may have other various sizes, and more than one overlay may be placed on top of a work surface 930,932 of the portfolio 910, as desired.

Each overlay 934,936 and each work surface 930,932 are preferably releasably cohered together utilizing magnetic forces. Furthermore, the overlays 934,936 preferably are interchangeable for use with either work surface 930,932 of the portfolio 910. In this regard, each overlay 934,936 preferably comprises a magnet, and each work surface 930,932 preferably includes a thin sheet of metal encased in vinyl, to which each magnetic overlay 934,936 sticks. The magnetic attraction preferably is strong enough such that the scrapbooking page and elements thereof do not detract sufficiently from the magnetic forces so as to reduce operability of the invention.

As described above, each overlay 934,936 is opaque in some embodiments and does not include any clear, translucent portions. However, in other embodiments, each overlay 934,936 may include one or more clear, translucent portions provided that sufficient magnetic forces remain present for securing any arrangement of elements by the overlay 934, 936.

Each work surface 930,932 of the portfolio 910 is preferably approximately twelve inches by twelve inches; however, the portfolio 910 can be developed in various different sizes, as desired, in order to fit the sizes of scrapbooking pages with which the portfolio 910 is intended to be used. In addition to the rubber feet 942, the exterior of the carrying case 912 of the portfolio 910 and/or the overlays 934,936 may include customized indicia and/or advertisements relating to scrapbooking. Logos, for example, can be imprinted onto or otherwise formed in the exterior surface of the carrying case 912 and/or the overlays 934,936.

In use, two draft scrapbooking pages are laid out on the slidable work surfaces 930,932 of the portfolio carrying case 912. In this regard, the portfolio 910 lies flat with the two clam shell-shaped halves 914,916 disposed in parallel relation to one another on a common horizontal surface of a desk. Each work surface 930,932 thereby presents a work space for respective arrangement of loose elements on a scrapbooking page. Two layouts thereby can be designed simultaneously. This is especially convenient when the two scrapbooking pages are to correspond to each other, either in subject matter, design layout, or otherwise. For example, the two scrapbooking pages may be designed to collectively make a coordinated presentation.

Each draft scrapbooking page includes pictures and other elements set forth in particular preliminary arrangements which may or may not ultimately represent the final scrapbooking pages. None of the elements of the draft scrapbooking pages have been adhered or otherwise permanently affixed directly to the scrapbooking page. Accordingly, each element of the draft scrapbooking page is said to be "loosely" arranged on the draft scrapbooking page.

Each respective overlay 934,936 may be positioned without altering the particular arrangement of the elements. Furthermore, the overlays 934,936 cohere to the work surfaces 930,932, and thereby retain the elements of the draft scrapbooking page in the particular arrangement on the scrapbooking page. In placing an overlay 934,936 onto a work surface 930,932, the overlay 934,936 is preferably pressed to remove any air bubbles that might be trapped between the overlay 934,936 and the work surface. By pressing out the air bubbles, better cohesion is insured between the work surface and the overlay 934,936.

Generally, the first overlay 934 is arranged over the first work surface 930 as described above, and once the first overlay 934 is in place, the second overlay 936 is positioned over the other work surface 932 of the portfolio 910 for securely retaining the loose elements of the other draft scrapbooking page, which elements are disposed in a particular arrangement. With the two overlays 934,936 covering the arrangements of elements of the draft scrapbooking pages, the portfolio 910 may be closed after replacing all the unused scrapbooking elements in the inner liners 926,928 of the carrying case 912, sliding the two work surfaces 930,932 into a closed position within the tracks of the inner liners 926,928 and by closing the carrying case 912 by folding one clam shell-shaped half 914,916 of the portfolio 910 over the other, as shown by the portfolios 910 on the right side of FIG. 24. The magnetic closure of the carrying case 912 thereby securely retains the two arrangements of elements of the draft scrapbooking pages. The portfolio 910 then may be stored or transported by means of the carrying handles 918, 920, as desired, without disturbing the arrangements of the elements on the draft scrapbooking pages.

As will be apparent from the foregoing detailed description, a draft scrapbooking page including elements loosely arranged thereon now can be secured and protected during transport and/or storage between scrapbooking sessions. A scrapbooker may begin a subsequent scrapbooking session using a draft scrapbooking page having the preserved arrangement of elements in exactly the same configurations and orientations as the last scrapbooking session.

Embodiments of the present invention further provide a portable work surface for creating a layout of one or more scrapbooking pages as well as a familiar, clean work surface regardless of the environment of the scrapbooking activity. The work surfaces of embodiments of the invention furthermore preferably are strong enough to enable scrapbooking in one's lap. Accordingly, scrapbookers are now provided with the opportunity to crop in locations that never before were imagined, such as at soccer practice or on long car trips, wherein the scrapbooker may stop designing a page layout at a moment's notice and preserve the work performed by the scrapbooker up until that point for a later scrapbooking session. Indeed, a scrapbookers no longer will have to re-create a previous design that was not completed during the last scrapbooking or cropping session. A scrapbooker now can continue the design process until a store closes or a baby wakes up, rather than stopping early because the scrapbooker fears that there will be insufficient time in which to complete any design that is started.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An apparatus for securely holding and protecting a layout of elements, comprising:

(a) a work surface defining an area adapted to receive elements loosely placed thereon in a particular arrangement;

(b) a plurality of permanent magnets located under said work surface; and (c) an overlay having an area generally corresponding to the area of the work surface, said overlay comprising a pliable sheet containing metal filings;

(d) wherein said permanent magnets are arranged under said work surface such that, when said overlay is positioned on said work surface in covering relation to said area of said work surface, said overlay and said work surface are releasably cohered together such that any loosely placed elements are retained on said work surface in the particular arrangement, (e) wherein said permanent magnets are disposed in a substrate formed from a plastic material, the substrate including a plurality of openings, each opening having one of the permanent magnets disposed therein.

2. The apparatus of claim 1, wherein the apparatus comprises a handle configured for carrying of the apparatus by hand.

3. The apparatus of claim 1, further comprising an arrangement of loosely placed elements retained between said overlay and said work surface.

4. The apparatus of claim 1, further comprising (a) a second work surface defining a second area adapted to receive elements loosely placed thereon in a particular arrangement;

(b) a second plurality of permanent magnets located under said second work surface;

(c) a second overlay having an area generally corresponding to the second area of the second work surface, said second overlay comprising a pliable sheet containing metal filings;

(d) wherein said second plurality of permanent magnets are arranged under said second work surface such that, when said second overlay is positioned on said second work surface in covering relation to said second area of said second work surface, said second overlay and said second work surface are releasably cohered together such that any loosely placed elements are retained on said second work surface in the particular arrangement; and (e) wherein the apparatus comprises a portfolio in which said work surfaces are hingedly connected to one another, the portfolio configured to transition between a closed position, wherein said two work surfaces are disposed in spaced, substantially parallel relation, and an open position, wherein said two work surfaces are disposed in generally coplanar relation.

5. A method of securing an arrangement of loose elements in a particular arrangement, comprising the steps of:

(a) positioning the loose elements on top of a work surface in a particular arrangement, the work surface being disposed above a substrate formed from a plastic material, the substrate including a plurality of openings, each opening having a permanent magnet disposed therein; and (b) positioning an overlay on top of the loose elements without altering the particular arrangement of the loose elements, wherein the overlay magnetically coheres to the work surface and retains the elements in the particular arrangement.

6. The method of claim 5, wherein the work surface is secured to a first cover of two covers of a portfolio, and further comprising the step of closing the covers of the portfolio to retain the work surface and the overlay between the two covers of the portfolio.

7. The method of claim 6, further comprising the step of hand carrying the portfolio.

8. The method of claim 5, further comprising pressing the overlay to remove air bubbles trapped between the overlay and the work surface.

9. The method of claim 5, wherein the work surface is a work surface of a portfolio, and further comprising the steps of:

(a) placing the portfolio, which comprises two covers, on a table, the portfolio being configured to transition between a closed configuration and an open configuration based on hinging movement of the two covers; and (b) transitioning the portfolio from the closed configuration to the open configuration via hinging movement of one of the covers relative to the other cover such that the covers lie generally flat on a top of the table.

10. The method of claim 9, wherein the portfolio includes feet, and wherein the step of transitioning the portfolio to the open configuration comprises transitioning the portfolio such that the portfolio is supported on the top of the table by the feet.

* * * * *